US009602910B2

(12) United States Patent
Kim et al.

(10) Patent No.: US 9,602,910 B2
(45) Date of Patent: Mar. 21, 2017

(54) EAR JACK RECOGNITION METHOD AND ELECTRONIC DEVICE SUPPORTING THE SAME

(71) Applicant: Samsung Electronics Co., Ltd, Suwon-si (KR)

(72) Inventors: Seok Weon Kim, Suwon-si (KR); Dong Hyeob Oh, Suwon-si (KR); Sung Chul Park, Seoul (KR)

(73) Assignee: SAMSUNG ELECTRONICS CO., LTD, Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/009,698

(22) Filed: Jan. 28, 2016

(65) Prior Publication Data

US 2016/0219359 A1 Jul. 28, 2016

(30) Foreign Application Priority Data

Jan. 28, 2015 (KR) ..... 10-2015-0013489

(51) Int. Cl.
*H04R 1/10* (2006.01)
*H04R 29/00* (2006.01)

(52) U.S. Cl.
CPC ..... *H04R 1/1041* (2013.01); *H04R 29/004* (2013.01); *H04R 2420/05* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 7,912,501 | B2 | 3/2011 | Johnson et al. | |
| 8,861,743 | B2 * | 10/2014 | Pantfoerder | H04R 1/1041 307/125 |
| 9,025,788 | B2 * | 5/2015 | Ha | H04R 1/1041 381/71.6 |
| 9,094,759 | B2 * | 7/2015 | Sagong | H04R 1/1041 |
| 9,103,866 | B2 * | 8/2015 | Mehrabi | G01R 31/04 |
| 9,179,233 | B2 | 11/2015 | Kang | |
| 9,282,391 | B2 * | 3/2016 | Jung | H04R 1/1041 |
| 2005/0090141 | A1 * | 4/2005 | Peng | H01R 24/58 439/488 |
| 2007/0049103 | A1 * | 3/2007 | Kashi | H01R 24/58 439/396 |

(Continued)

FOREIGN PATENT DOCUMENTS

| | | | |
|---|---|---|---|
| KR | 20130036906 | A | 4/2013 |
| KR | 101267047 | B1 | 5/2013 |

*Primary Examiner* — Paul Huber

(57) ABSTRACT

An electronic device is provided. The electronic device connects to an earphone. The electronic device includes a connector into which an ear jack of the earphone is inserted, an audio controller configured to process an acoustic signal, a processor configured to control the audio controller, and a memory configured to functionally connect with the processor. The audio controller outputs a first acoustic signal through an ear speaker of the earphone, if an insertion interruption occurs according to insertion of the ear jack. The processor determines a type of the ear jack according to a second acoustic signal collected through an ear microphone included in the earphone.

20 Claims, 13 Drawing Sheets

(56) References Cited

U.S. PATENT DOCUMENTS

| | | | | |
|---|---|---|---|---|
| 2012/0308031 | A1* | 12/2012 | Sun | H04R 5/04<br>381/74 |
| 2013/0089216 | A1 | 4/2013 | Han | |
| 2013/0259246 | A1 | 10/2013 | Kang | |

* cited by examiner

EAR JACK RECOGNITION METHOD AND ELECTRONIC DEVICE SUPPORTING THE SAME

CROSS-REFERENCE TO RELATED APPLICATION(S) AND CLAIM OF PRIORITY

The present application is related to and claims the benefit under 35 U.S.C. §119(a) of a Korean patent application filed on Jan. 28, 2015 in the Korean Intellectual Property Office and assigned Serial number 10-2015-0013489, the entire disclosure of which is hereby incorporated by reference.

TECHNICAL FIELD

The present disclosure relates to a method for recognizing an ear jack and an electronic device supporting the same.

BACKGROUND

Electronic devices, such as smartphones or table computers, may provide a variety of functions such as a media output function. A user may connect an acoustic output device, such as an earphone or a headset, to his or her electronic device and may listen to a sound output from the electronic device. The acoustic output device may be implemented with various forms and may include a microphone.

The acoustic output device may connect with the electronic device through an ear jack of the acoustic output device. If the acoustic output device includes the microphone, the ear jack may further include a terminal for processing a signal associated with the microphone. The electronic device may recognize a type of the ear jack and may communicate a signal suitable for the type of the ear jack.

Since an additional circuit, such as a comparator or an analog to digital converter (ADC), is included in the electronic device in an ear jack recognition method according to the related art, complexity of the electronic device is increased.

SUMMARY

To address the above-discussed deficiencies, it is a primary object to provide at least the advantages described below.

In accordance with an aspect of the present disclosure, an electronic device is provided. The electronic device may connect to an earphone. The electronic device may include a connector into which an ear jack of the earphone is inserted, an audio controller configured to process an acoustic signal, a processor configured to control the audio controller, and a memory configured to functionally connect with the processor. The audio controller may output a first acoustic signal through an ear speaker of the earphone, if an insertion interruption occurs according to insertion of the ear jack. The processor may determine a type of the ear jack according to a second acoustic signal collected through an ear microphone included in the earphone.

Other aspects, advantages, and salient features of the disclosure will become apparent to those skilled in the art from the following detailed description, which, taken in conjunction with the annexed drawings, discloses various embodiments of the present disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Throughout the drawings, it should be noted that like reference numbers are used to depict the same or similar elements, features, and structures.

DETAILED DESCRIPTION

Figure 1:
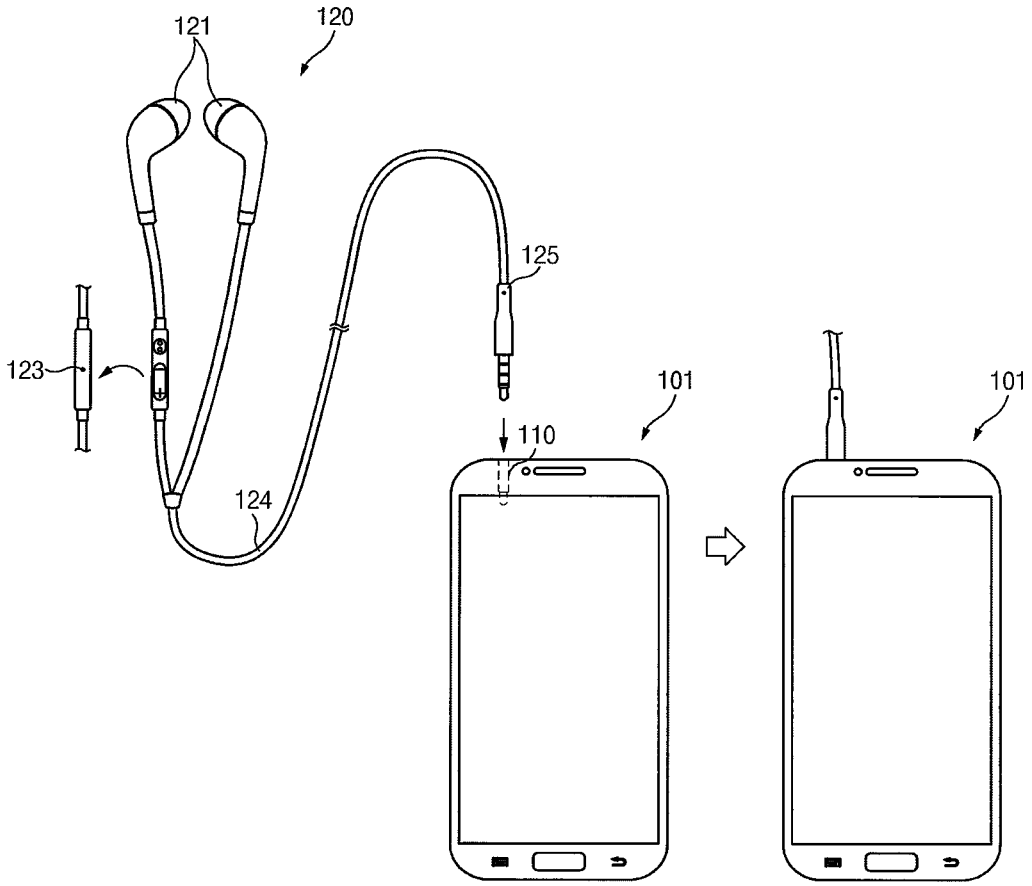
FIG. 1 is a drawing illustrating an electronic device according to various embodiments of the present disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device. Hereinafter, the present disclosure is described with reference to the accompanying drawings. However, the present disclosure is not intended to be limited to the specific embodiments, and it is understood that it should include various modifications, equivalents, and/or alternatives within the scope and technical range of the present disclosure. With respect to the descriptions of the drawings, like reference numerals refer to like elements.

In the disclosure disclosed herein, the expressions "have", "may have", "include" and "comprise", or "may include" and "may comprise" used herein indicate existence of corresponding features (e.g., elements such as numeric values, functions, operations, or components) but do not exclude presence of additional features.

In the disclosure disclosed herein, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The expressions such as "1st", "2nd", "first", or "second", and the like used in various embodiments of the present disclosure may refer to various elements irrespective of the order and/or priority of the corresponding elements, but do not limit the corresponding elements. The expressions may be used to distinguish one element from another element. For instance, both a first user device and a second user device indicate different user devices from each other irrespective of the order or priority of the corresponding elements. For example, a first component may be referred to as a second component and vice versa without departing from the scope of the present disclosure.

It will be understood that when an element (e.g., a first element) is referred to as being "(operatively or communicatively) coupled with/to" or "connected to" another element (e.g., a second element), it can be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element) between the element and the other element.

Depending on the situation, the expression "configured to" used herein may be used as, for example, the expression "suitable for", "having the capacity to", "designed to", "adapted to", "made to", or "capable of". The term "configured to" should not mean only "specifically designed to" hardwarily. Instead, under any situation, the expression "a device configured to" may mean that the device is "capable of" operating together with another device or other components. For example, a "processor configured to perform A, B, and C" may mean a generic-purpose processor (e.g., a central processing unit (CPU) or an application processor) which may perform corresponding operations by executing one or more software programs which stores a dedicated processor (e.g., an embedded processor) for performing a corresponding operation.

Terms used in this specification are used to describe specified embodiments of the present disclosure and are not intended to limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even if terms are terms which are defined in the specification, they may not be interpreted to exclude embodiments of the present disclosure.

Electronic devices according to various embodiments of the present disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), motion picture experts group (MPEG-1 or MPEG-2) audio layer 3 (MP3) players, mobile medical devices, cameras, or wearable devices (e.g., smart glasses, head-mounted-devices (HMDs), an electronic apparel, electronic bracelets, electronic necklaces, electronic appcessories, electronic tattoos, smart mirrors, or smart watches).

According to various embodiments of the present disclosure, the electronic devices may be smart home appliances. The smart home appliances may include at least one of, for example, televisions (TVs), digital versatile disk (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ and PlayStation™), electronic dictionaries, electronic keys, camcorders, or electronic picture frames.

According to various embodiments of the present disclosure, the electronic devices may include at least one of various medical devices (e.g., various portable medical measurement devices (e.g., blood glucose meters, heart rate meters, blood pressure meters, or thermometers, and the like), a magnetic resonance angiography (MRA), a magnetic resonance imaging (MRI), a computed tomography (CT), scanners, or ultrasonic devices, and the like), navigation devices, global positioning system (GPS) receivers, event data recorders (EDRs), flight data recorders (FDRs), vehicle infotainment devices, electronic equipment for vessels (e.g., navigation systems, gyrocompasses, and the like), avionics, security devices, head units for vehicles, industrial or home robots, automatic teller's machines (ATMs), points of sales (POSs), or internet of things (e.g., light bulbs, various sensors, electric or gas meters, sprinkler devices, fire alarms, thermostats, street lamps, toasters, exercise equipment, hot water tanks, heaters, boilers, and the like).

According to various embodiments of the present disclosure, the electronic devices may include at least one of parts of furniture or buildings/structures, electronic boards, electronic signature receiving devices, projectors, or various measuring instruments (e.g., water meters, electricity meters, gas meters, or wave meters, and the like). According to various embodiments of the present disclosure, the electronic devices may be one or more combinations of the above-mentioned devices. The electronic devices according to various embodiments of the present disclosure may be flexible electronic devices. Also, the electronic devices according to various embodiments of the present disclosure are not limited to the above-mentioned devices, and may include new electronic devices according to technology development Hereinafter, the electronic devices according to various embodiments of the present disclosure will be described with reference to the accompanying drawings. The term "user" used herein may refer to a person who uses an electronic device or may refer to a device (e.g., an artificial electronic device) which uses an electronic device.

FIG. 1 is a drawing illustrating an electronic device according to various embodiments of the present disclosure.

Referring to FIG. 1, an electronic device 101 may perform an acoustic output function using a speaker of the electronic device 101 and an acoustic input function using a microphone of the electronic device 101. The electronic device 101 may output a call voice or an acoustic signal (e.g., music, a movie sound, and the like) associated with a media output through the speaker. The electronic device 101 may collect a user voice or an external acoustic signal through the microphone.

The electronic device 101 may output an acoustic signal or may collect an acoustic signal around the electronic device 101, through an acoustic input and output device (e.g., an ear speaker or an ear microphone, and the like) included in an auxiliary accessory device (e.g., an earphone, a headset, and the like). Hereinafter, an embodiment of the present disclosure is exemplified as an earphone 120 connects to the electronic device 101. However, the scope and spirit of the present disclosure may not be limited thereto.

The electronic device 101 may include a connector 110. The connector 110 may be implemented in a form which becomes concave in an inner direction of the electronic device 101. An ear jack 125 connected with the earphone 120 may be inserted into the connector 110. The connector 110 may be implemented with a form corresponding to the ear jack 125 and may include a terminal corresponding to each terminal included in the ear jack 125.

According to various embodiments of the present disclosure, if the ear jack 125 is inserted into the connector 110, the electronic device 101 may output an acoustic signal, for recognizing a type of the ear jack 125, through at least one of a speaker (hereinafter referred to as a "main speaker (not shown)") included in the electronic device 101 or an ear speaker 121 mounted on the earphone 120. The electronic device 101 may collect the acoustic signal through at least one of a microphone (hereinafter referred to as a "main microphone (not shown)") mounted on the electronic device 101 or an ear microphone 123 (if the earphone 120 includes the ear microphone 123) and may recognize a type of the ear jack 125 according to the collected signal. Additional information about an ear jack recognition method through the output of the acoustic signal of the electronic device 101 may be provided with reference to FIGS. 2 to 11.

The earphone 120 may include the ear speakers 121, an ear microphone 123, a connection par 124, and the ear jack 125.

The ear speaker 121 may convert an electric signal for outputting an acoustic signal into a sound and may output the converted sound. A user of the electronic device 101 may insert the ear speakers 121 into his or her ears and may listen to a sound output from the electronic device 101.

The ear microphone 123 may collect an acoustic signal around the electronic device 101. The ear microphone 123 may be spaced from the ear speaker 121 at a predetermined distance (e.g., 15 centimeters to 20 centimeters). If the user inserts the ear speaker 121 into his or her ears, the ear microphone 123 may be disposed in a point corresponding to a position of the mouth of the user.

The connection part 124 may connect between components of the earphone 120 (e.g., between the ear speaker 121 and the ear microphone 123 and between the ear microphone 123 and the ear jack 125). The connection part 124 may include a wire for transmitting an electric signal to the inside.

The ear jack 125 may connect to the connector 110 by being inserted into the connector 110. According to various embodiments of the present disclosure, the ear jack 125 may have a form of a three-pole terminal or a four-pole terminal. The three-pole terminal may have a form including a ground terminal, a right output terminal, and a left output terminal. The four-pole terminal may have a form in which a microphone terminal is added to the three-pole terminal. If the ear jack 125 is inserted into the connector 110, an interruption (hereinafter referred to as an "insertion interruption") by contact between terminals may occur. The insertion interruption may be used as a start signal for starting an operation in which the electronic device 101 recognizes a type of the inserted ear jack 125.

Figure 2:
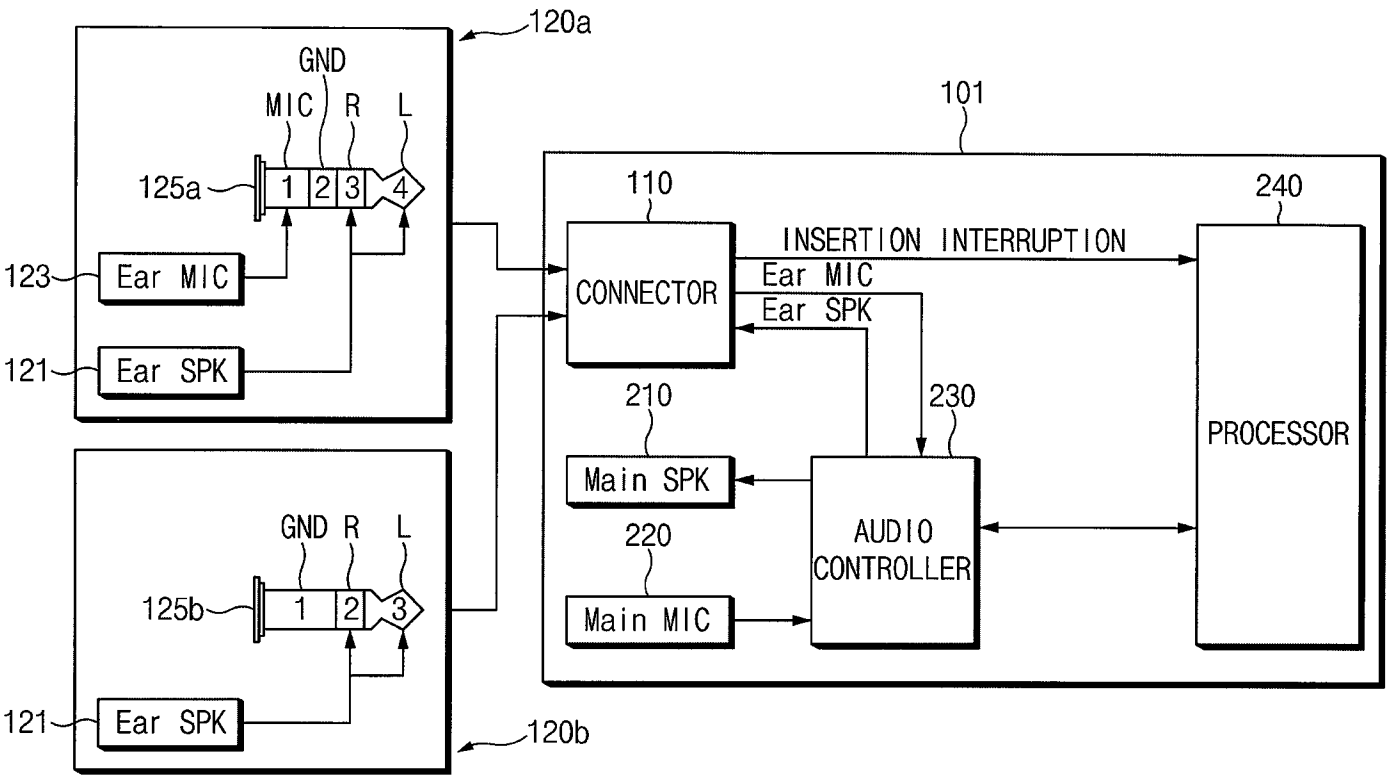
FIG. 2 is a block diagram illustrating a configuration of an earphone of three-pole/four-pole terminal and a configuration of an electronic device according to various embodiments of the present disclosure.

FIG. 2 is a block diagram illustrating a configuration of an earphone of a three-pole/four-pole terminal and a configuration of an electronic device according to various embodiments of the present disclosure.

Referring to FIG. 2, an electronic device 101 may include a connector 110, a main speaker 210, a main microphone 220, an audio controller 230, and a processor 240. Some of the connector 110, the main speaker 210, the main microphone 220, the audio controller 230, and the processor 240 may be integrated or separated. For example, the audio controller 230 may be included in the processor 240 and may be integrated with the processor 240.

The connector 110 may be implemented to correspond to all of ear jacks of a three-pole terminal and a four-pole terminal. The electronic device 101 may determine whether the ear jack of the three-pole terminal is inserted into the connector 110 or whether the ear jack of the four-pole terminal including a microphone terminal is inserted into the connector 110. The electronic device 101 may communicate a control signal or an acoustic input and output signal, corresponding to each ear jack (e.g., an ear jack 125*a* of a four-pole terminal or an ear jack 125*b* of a three-pole terminal), with an earphone 120*a* or 120*b*.

According to various embodiments of the present disclosure, if the ear jack 125*a* or 125*b* is inserted into the connector 110, an insertion interruption may occur due to contact between terminals. The insertion interruption may be used as a start signal for starting an operation in which the electronic device 101 recognizes a type of the inserted ear jack 125*a* or 125*b*. The connector 110 may provide a signal about the insertion interruption to the processor 240.

The main speaker 210 may output an acoustic signal provided from the audio controller 230. If the ear jack 125*a* or 125*b* is inserted into the connector 110, the main speaker 210 may operate in a way selective or restrictive with respect to an ear speaker 121 (e.g., may output not a media acoustic signal but a predetermined acoustic signal).

According to various embodiments of the present disclosure, if the ear jack 125*a* or 125*b* is inserted into the connector 110, the main speaker 210 may output a predetermined acoustic signal for recognizing a type of the ear jack 125*a* or 125*b*. The acoustic signal output through the main speaker 210 may be collected through at least one of an ear microphone 123 (if an earphone 120*a* includes the ear microphone 123) or a main microphone 220. The electronic device 101 may determine a type of the ear jack 125*a* or 125*b* according to the collected acoustic signal.

The main microphone 220 may collect an acoustic signal around the electronic device 101. The main microphone 220 may be used in an application such as a call app or a voice record app. According to various embodiments of the present disclosure, the main microphone 220 may collect a signal output from the main speaker 210 or the ear speaker 121. The collected acoustic signal may be used to determine a type of the ear jack 125*a* or 125*b*.

The audio controller 230 may perform signal conversion and data processing for inputting and outputting an acoustic signal. The audio controller 230 may perform a function of converting a sound output or collected through the main speaker 210 or the main microphone 220 into an electronic signal or a signal of a predetermined format. The audio controller 230 may provide the converted signal to the processor 240. And the audio controller 230 may receive and process a control signal or an acoustic signal from the processor 240.

The processor 240 may provide a control signal or an acoustic signal to the audio controller 230. If an insertion interruption occurs, the processor 240 may provide a control signal, for recognizing an ear jack, to the audio controller 230. An embodiment of the present disclosure is exemplified as the audio controller 230 and the processor 240 are divided according to their functions. However, the scope and spirit of the present disclosure may not be limited thereto. For example, the audio controller 230 and the processor 240 may be implemented with an integrated form.

The earphone 120*a* or 120*b* may connect to the electronic device 101 by being inserted into the connector 110. The earphone 120*a* may include the ear microphone 123, and the earphone 120*b* may not include a separate microphone. The earphone 120*b* may include the ear jack 125*b* of a three-pole terminal which does not include a terminal for a separate microphone to be distinguished from the earphone 120*a*.

The earphone 120*a* may include the ear speaker 121, the ear microphone 123, and the ear jack 125*a* of the four-pole terminal. The ear jack 125*a* of the four-pole terminal may include a microphone terminal MIC, a ground terminal GND, a right speaker terminal R, and a left speaker terminal L. The earphone 120*b* may include the ear speaker 121 and the ear jack 125*b* of the three-pole terminal. The ear jack 125*b* of the three-pole terminal may include a ground terminal GND, a right output terminal R, and a left output terminal L.

If an insertion interruption occurs after the earphone 120*a* or 120*b* is inserted into the connector 110, the electronic device 101 may output a predetermined acoustic signal through at least one of the ear speaker 121 or the main speaker 210. The output acoustic signal may be collected through at least one of the ear microphone 123 or the main microphone 220. For one example, if the earphone 120*a* including the ear microphone 123 connects to the connector 110, the electronic device 101 may compare an acoustic signal collected through the ear microphone 123 with a previously stored acoustic signal (or an acoustic signal collected through the main microphone 220) and may recognize that the earphone 120*a* of the four-pole terminal connects to the connector 110.

For another example, if the earphone 120*b* which does not include a separate microphone connects to the connector 110, the electronic device 101 may not receive an acoustic signal through an ear microphone and may recognize that the earphone 120*b* of the three-pole terminal connects to the connector 110.

According to various embodiments of the present disclosure, the electronic device which may connect to the earphone may include a connector into which an ear jack of the earphone is inserted, an audio controller configured to process an acoustic signal, a processor configured to control the audio controller, and a memory configured to be functionally connected with the processor. The audio controller may output a first predetermined signal through an ear speaker of the earphone, if an interruption occurs according to insertion of the ear jack. The processor may determine a type of the ear jack according to a second acoustic signal collected through an ear microphone which may be included in the earphone. The processor may compare the previously stored first acoustic signal with the second acoustic signal and may determine the type of the ear jack.

According to various embodiments of the present disclosure, the electronic device may further include a main speaker. The audio controller may output the first predetermined acoustic signal through at least one of the ear speaker or the main speaker.

According to various embodiments of the present disclosure, the electronic device may further include a main microphone. The processor may determine the type of the ear jack according to at least one of the second acoustic signal collected through the ear microphone or a third acoustic signal collected through the main microphone.

According to various embodiments of the present disclosure, the main microphone may collect a noise signal around the electronic device. The audio controller may cancel the collected noise signal from the second acoustic signal. According to various embodiments of the present disclosure, the audio controller may further include an adaptive filter which receives feedback on a second acoustic signal in which the noise signal is cancelled.

According to various embodiments of the present disclosure, the processor may compare the second acoustic signal with the third acoustic signal and may determine the type of the ear jack according to the compared result. The main microphone may collect a first acoustic signal output from the main speaker. The ear microphone may collect a first acoustic signal output from the ear speaker. The first acoustic signal may be an inaudible signal or an audible signal of a predetermined frequency or less. The first acoustic signal may be repeatedly output according to at intervals of a predetermined time.

According to various embodiments of the present disclosure, the ear jack may have one of a form of a three-pole terminal including a ground terminal, a right output terminal, and a left output terminal and a form of a four-pole terminal including a microphone, a ground terminal, a right speaker terminal, and a left speaker terminal.

Figure 3:
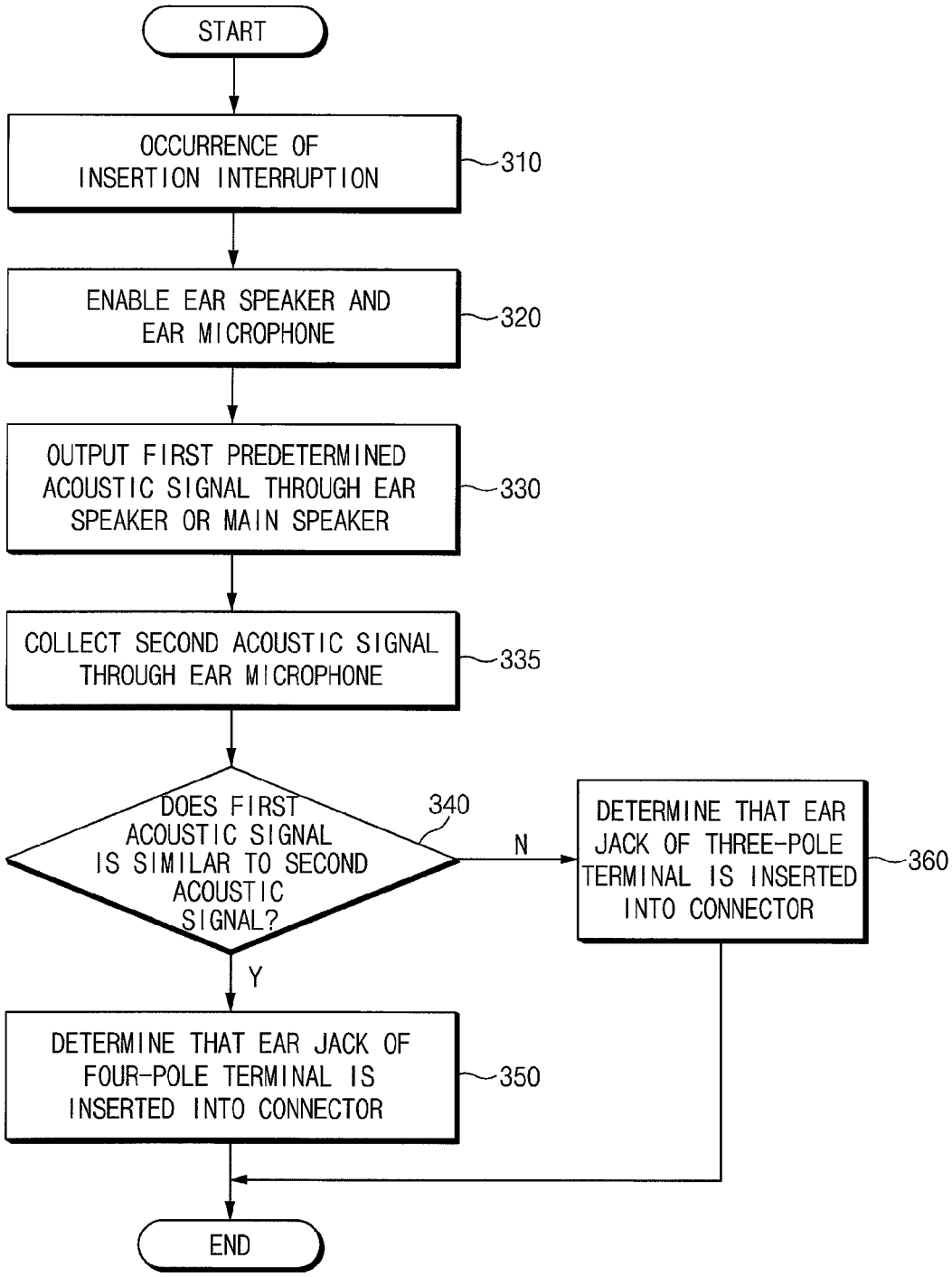
FIG. 3 is a flowchart illustrating an ear jack recognition method through an ear speaker and an ear microphone according to various embodiments of the present disclosure.

FIG. 3 is a flowchart illustrating an ear jack recognition method through an ear speaker and an ear microphone according to various embodiments of the present disclosure.

Referring to FIG. 3, if an ear jack 125 is inserted into a connector 110, in operation 310, an insertion interruption may occur. The connector 110 may transmit an insertion interruption signal (or a signal corresponding to the insertion interruption) to a processor 240. If receiving the insertion interruption signal, the processor 240 may provide a control signal, for recognizing the ear jack 125, to an audio controller 230.

In operation 320, the processor 240 may transmit a control signal, for enabling an ear speaker 121 and an ear microphone 123, to the audio controller 230. The audio controller 230 may maintain the ear speaker 121 and the ear microphone 123 in an operable state (e.g., a state where an acoustic signal may be input or output) according to the control signal.

In operation 330, the audio controller 230 may output a first predetermined acoustic signal through the ear speaker 121 or a main speaker 210. According to various embodiments of the present disclosure, the first acoustic signal may be an inaudible signal or an audible signal of a predetermined frequency or less.

In operation 335, the ear microphone 123 may collect a second acoustic signal. The ear microphone 123 may mainly collect the first acoustic signal output from the ear speaker 121 or the main speaker 210. However, the scope and spirit of the present disclosure may not be limited thereto. For example, the ear microphone 123 may collect a noise signal and the like around an earphone 120.

In operation 340, the processor 240 may determine whether the second acoustic signal collected through the ear microphone 123 is similar to the previously stored first acoustic signal.

In operation 350, if the first acoustic signal is similar to the second acoustic signal (e.g., if similarity between the first acoustic signal and the second acoustic signal is greater than or equal to a predetermined value), the processor 240 may determine that an ear jack of a four-pole terminal is inserted into the connector 110. According to various embodiments of the present disclosure, if the ear microphone 123 is included in the earphone 120 (e.g., an earphone 120*a* of FIG. 2), the first acoustic signal and the second acoustic signal may be similar to each other.

In operation 360, if the first acoustic signal and the second acoustic signal are not similar to each other (e.g., if the similarity between the first acoustic signal and the second acoustic signal is less than the predetermined value), the processor 240 may determine that an ear jack of a three-pole terminal is inserted into the connector 110. If an ear microphone is not included in the earphone 120 (e.g., an earphone 120*b* of FIG. 2), since there is no signal collected through the ear microphone, the first acoustic signal and the second acoustic signal may not be similar to each other.

Figure 4B:
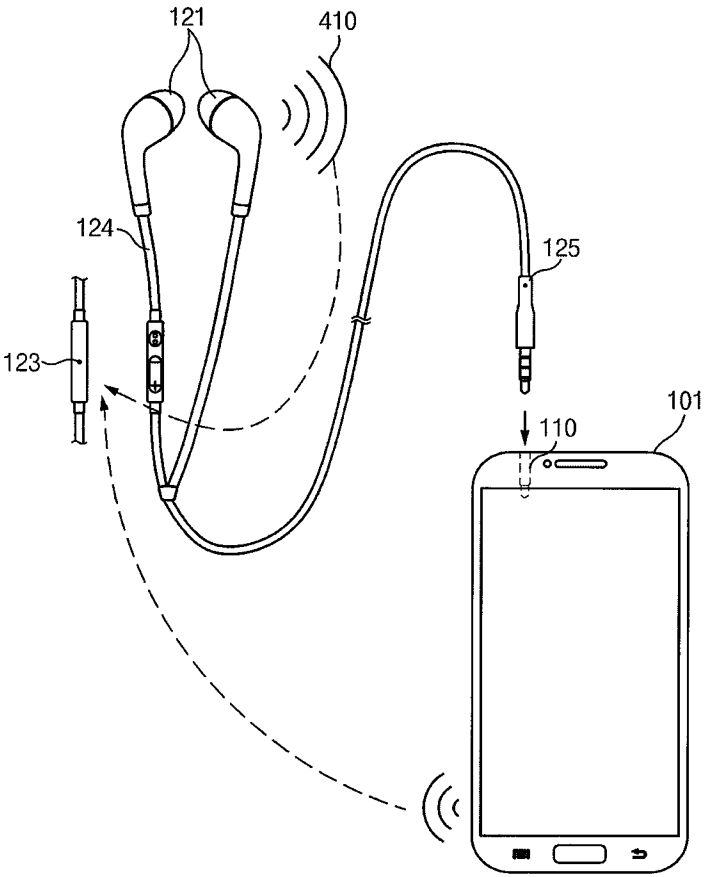
FIGS. 4A and 4B are drawings illustrating a recognition method of an earphone including an ear microphone according to various embodiments of the present disclosure.
Figure 4A:
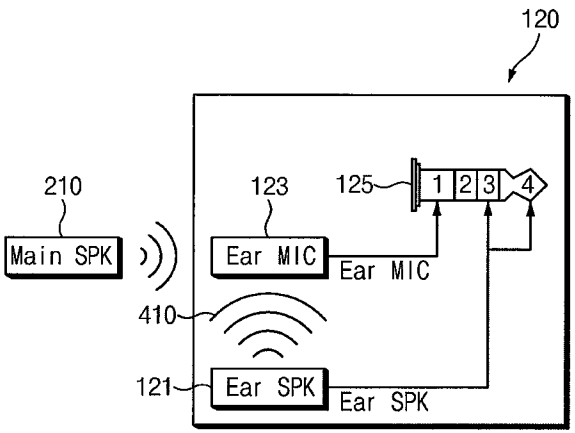

FIGS. 4A and 4B are drawings illustrating a recognition method of an earphone including an ear microphone according to various embodiments of the present disclosure.

Referring to FIGS. 4A and 4B, an earphone 120 may include an ear speaker 121, an ear microphone 123, a connection part 124, and an ear jack 125. The ear speaker 121 and the ear microphone 123 may be spaced apart from each other at a predetermined distance (e.g., 15 centimeters to 20 centimeters) and may connect through the connection part 124.

If receiving an insertion interruption signal from a connector 110, a processor 240 may provide a control signal, for recognizing the ear jack 125, to an audio controller 230. The audio controller 230 may output a first predetermined acoustic signal 410 through the ear speaker 121 or a main speaker 210. The output first acoustic signal 410 may be introduced into the ear microphone 123.

The processor 240 may determine whether a second acoustic signal collected through the ear microphone 123 is similar to the first acoustic signal stored in an internal memory of an electronic device 101. If the first acoustic signal and the second acoustic are similar to each other, the processor 240 may determine that an ear jack of a four-pole terminal is inserted into the connector 110.

Although not illustrated in FIGS. 4A and 4B, since an earphone of a three-pole terminal (e.g., an earphone 120*b* of FIG. 2) does not include a separate microphone, the earphone of the three-pole terminal may not collect the first acoustic signal output through the ear speaker 121 or the main speaker 210. In this case, a second acoustic signal introduced through a microphone terminal of the connector 110 may be in a state where a constant value is maintained (or a state where there is no separately collected signal). The processor 240 may determine that an ear jack of a three-pole terminal is inserted into the connector 110 by determining that the first acoustic signal and the second acoustic are not similar to each other.

Figure 5A:
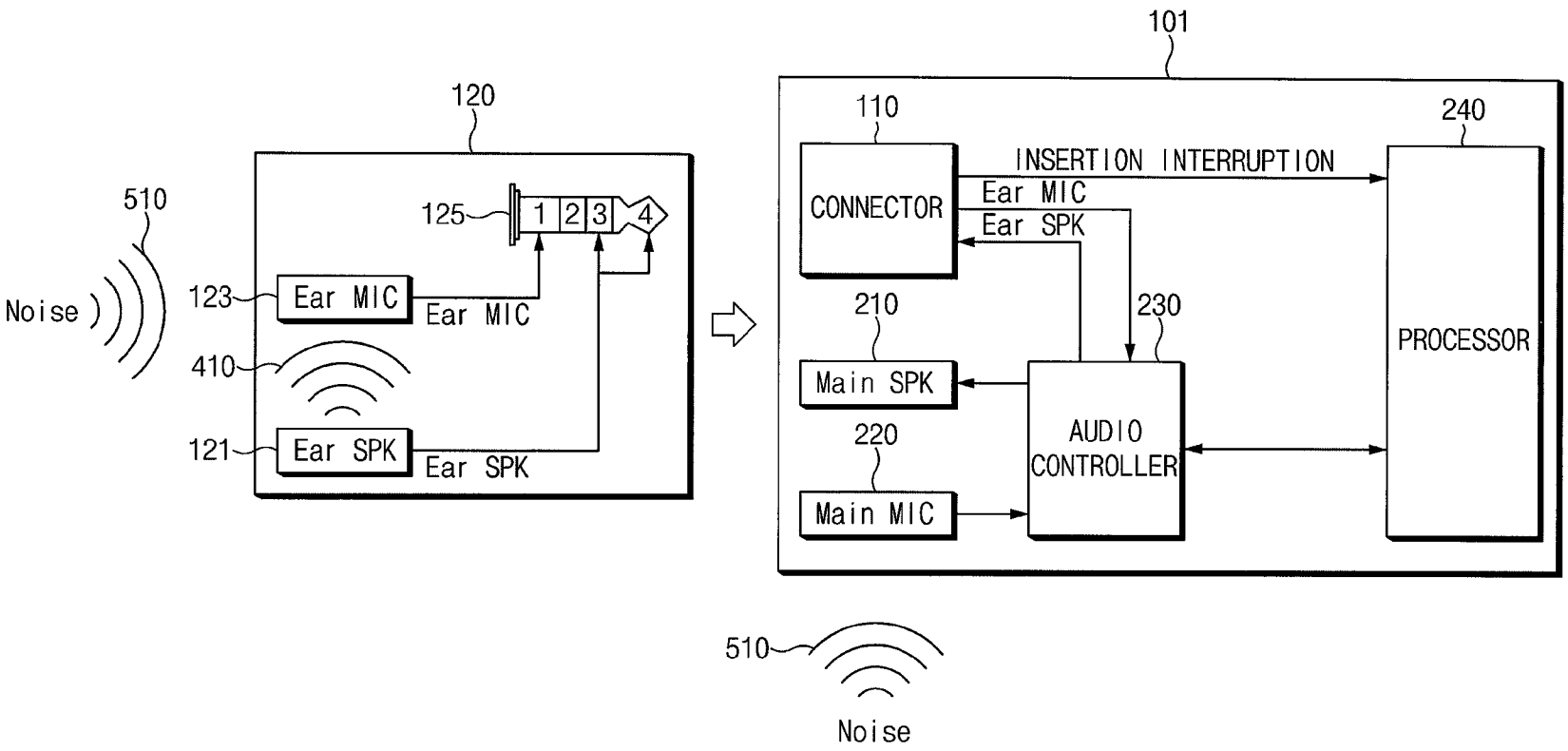
FIGS. 5A and 5B are drawings illustrating a noise cancellation function using a main microphone according to various embodiments of the present disclosure.
Figure 5B:
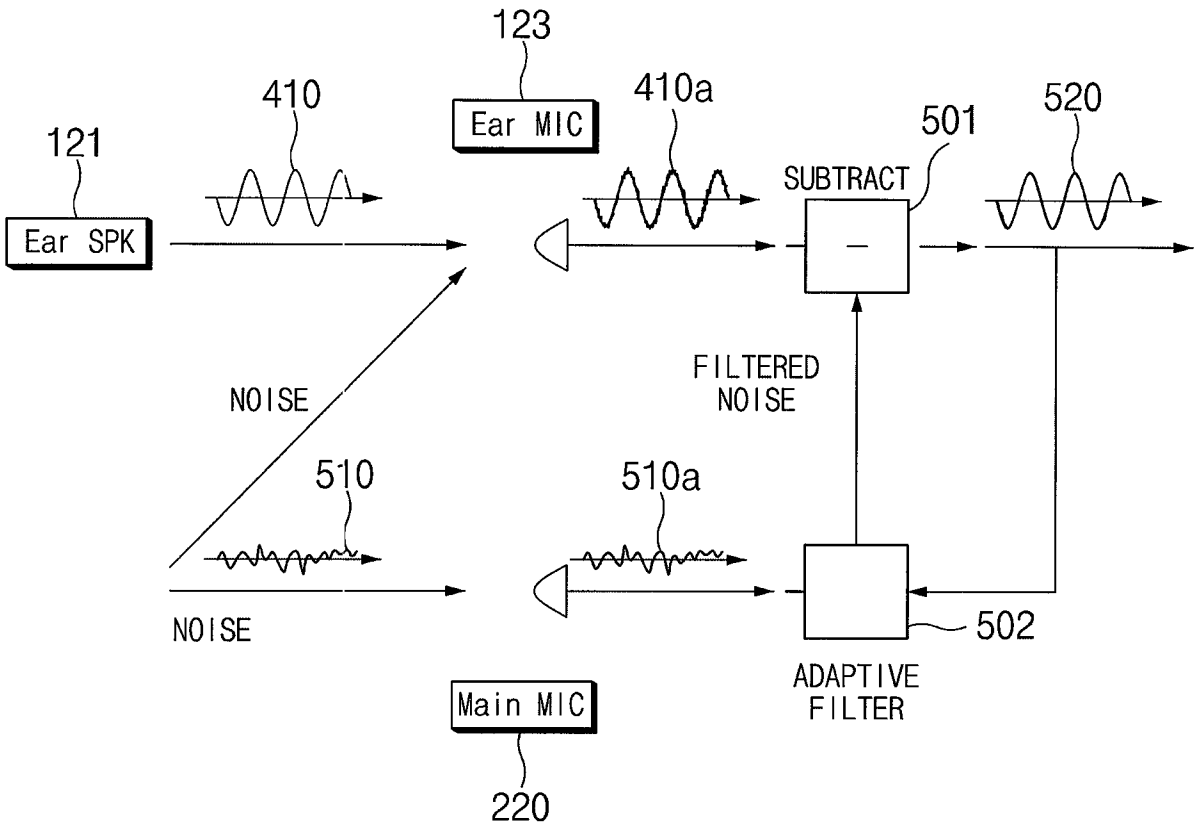

FIGS. 5A and 5B are drawings illustrating a noise cancellation function using a main microphone according to various embodiments of the present disclosure. An electronic device 101 may enhance a recognition rate of an ear jack 125 in a situation where there are many noises around the electronic device 101, through a noise cancellation function.

Referring to FIGS. 5A and 5B, an audio controller 230 may output a first predetermined acoustic signal 410 through an ear speaker 121. The output first acoustic signal 410 may be introduced into an ear microphone 123.

A noise signal 510 around the electronic device 101 may be simultaneously introduced into the ear microphone 123 and a main microphone 220. The ear microphone 123 may collect a signal 410*a* in which the noise signal 510 is combined to the first acoustic signal 410. The main microphone 220 may collect a signal 510*a* corresponding to the noise signal 510.

The audio controller 230 may cancel the signal 510*a* collected through the main microphone 220 from the signal 410*a* collected through the ear microphone 123 and may output a second acoustic signal 520 using a subtractor 501.

According to various embodiments of the present disclosure, the audio controller 230 may further include an adaptive filter 502. After the second acoustic signal 520 is fed back to the adaptive filter 502, the adaptive filter 502 may improve performance of noise cancellation by reducing difference between a noise collected through the main microphone 220 and a noise collected through the ear microphone 123. According to various embodiments of the present disclosure, a noise cancellation function using the subtractor 501 and the adaptive filter 502 may be processed through a separate controller separated from the audio controller 230.

The processor 240 may determine whether the second acoustic signal 520 is similar to the first acoustic signal 410 stored in an internal memory of the electronic device 101. If the first acoustic signal and the second acoustic signal are similar to each other, the processor 240 may determine that an ear jack of a four-pole terminal is inserted into the connector 110. If the first acoustic signal and the second acoustic signal are not similar to each other, the processor 240 may determine that an ear jack of a three-pole terminal is inserted into the connector 110.

Figure 6:
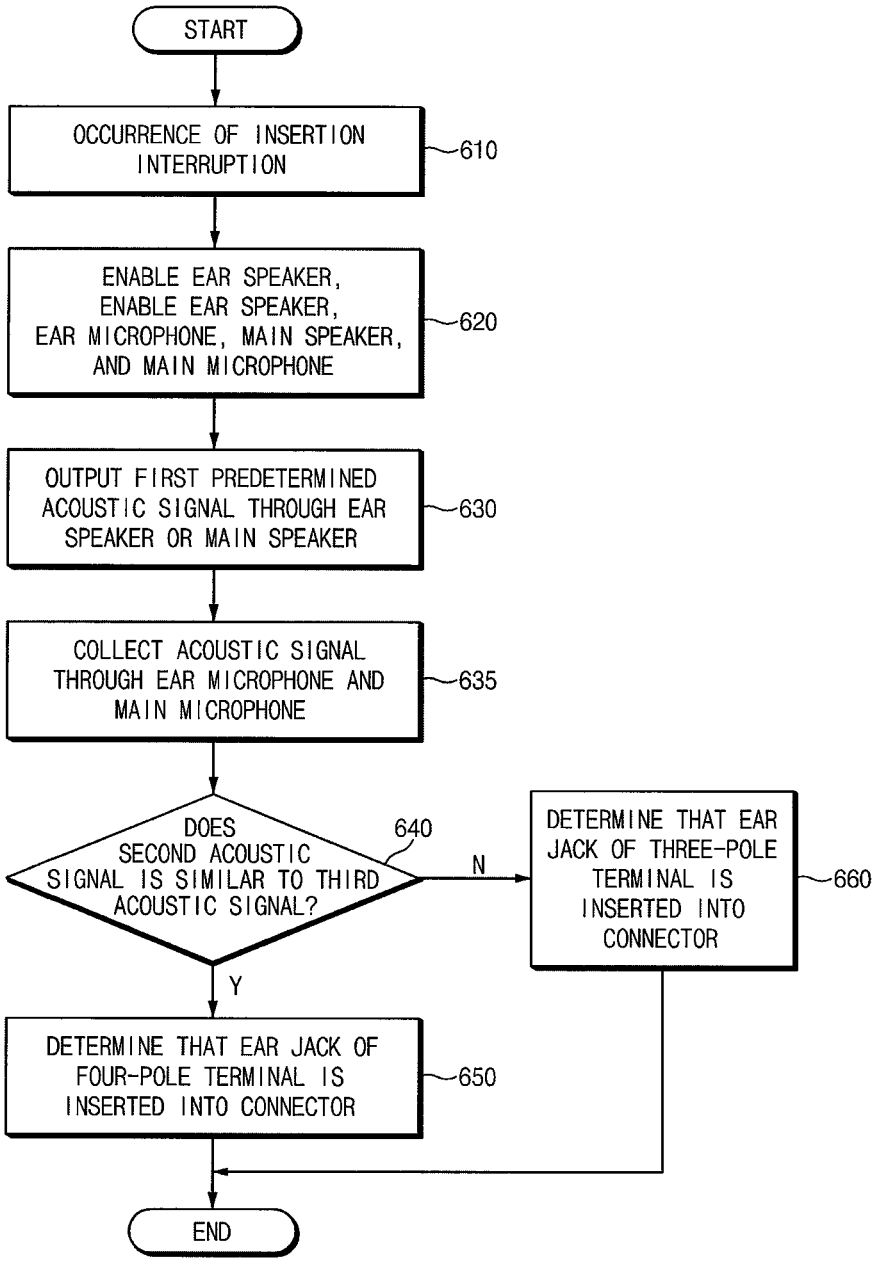
FIG. 6 is a flowchart illustrating a method for recognizing a type of an ear jack using an ear microphone and a main microphone according to various embodiments of the present disclosure.

FIG. 6 is a flowchart illustrating a method for recognizing a type of an ear jack using an ear microphone and a main microphone according to various embodiments of the present disclosure.

Referring to FIG. 6, if an ear jack 125 is inserted into a connector 110, in operation 610, an insertion interruption may occur. The connector 110 may transmit an insertion interruption signal to a processor 240. If receiving the insertion interruption signal, the processor 240 may provide a control signal, for recognizing the ear jack 125, to an audio controller 230.

In operation 620, the processor 240 may transmit a control signal, for enabling an ear speaker 121, an ear microphone 123, a main speaker 210, and a main microphone 220, to the audio controller 230. The audio controller 230 may maintain the ear speaker 121, the ear microphone 123, the main speaker 210, and the main microphone 220 in an operable state according to the control signal.

In operation 630, the audio controller 230 may output a first predetermined acoustic signal through each of the ear speaker 121 and the main speaker 210. According to various embodiments of the present disclosure, the first acoustic signal may be an inaudible signal or an audible signal of a predetermined frequency or less.

In operation 635, the ear microphone 123 and the main microphone 220 may collect an acoustic signal, respectively. The ear microphone 123 may mainly collect an acoustic signal output from the ear speaker 121. However, the scope and spirit of the present disclosure may not be limited thereto. For example, the ear microphone 123 may collect an acoustic signal output from the main speaker 210 or a noise signal and the like around an earphone 120. The main microphone 220 may mainly collect an acoustic signal output from the main speaker 210. However, the scope and spirit of the present disclosure may not be limited thereto. For example, the main microphone 220 may collect an acoustic signal output from the ear speaker 121 or a noise signal and the like around an electronic device 101.

In operation 640, the processor 240 may determine whether a second acoustic signal collected through the ear microphone 123 is similar to a third acoustic signal collected through the main microphone 220.

In operation 650, if the second acoustic signal and the third acoustic signal are similar to each other (e.g., if similarity between the second acoustic signal and the third acoustic signal is greater than or equal to a predetermined value), the processor 240 may determine that an ear jack of a four-pole terminal is inserted into the connector 110. For example, if the ear microphone 123 is included in the earphone 120 (e.g., an earphone 120*a* of FIG. 2), the second acoustic signal and the third acoustic signal may be similar to each other.

In operation 660, if the second acoustic signal and the third acoustic signal are not similar to each other (e.g., if the similarity between the first acoustic signal and the second acoustic signal is less than the predetermined value), the processor 240 may determine that an ear jack of a three-pole terminal is inserted into the connector 110. For example, if an ear microphone is not included in the earphone 120 (e.g., an earphone 120*b* of FIG. 2), since there is no signal collected through the ear microphone, the second acoustic signal and the third acoustic signal may not be similar to each other.

According to various embodiments of the present disclosure, the ear jack recognition method performed in the electronic device may include outputting a first predetermined acoustic signal if an insertion interruption of an ear jack connected to an earphone occurs and determining a type of the ear jack according to a second acoustic signal collected through an ear microphone of the earphone in response to the first acoustic signal. The determining of the type of the ear jack may include comparing the first acoustic signal previously stored in a memory included in the electronic device with the second acoustic signal and determining the type of the ear jack according to the compared result.

According to various embodiments of the present disclosure, the outputting of the first acoustic signal may include outputting the first acoustic signal through at least one of an ear speaker of the earphone and a main speaker of the electronic device.

According to various embodiments of the present disclosure, the determining of the type of the ear jack may include collecting the second acoustic signal through the ear microphone, collecting a third acoustic signal through a main microphone of the electronic device, and determining the type of the ear jack according to at least one of the second acoustic signal or the third acoustic signal.

According to various embodiments of the present disclosure, the determining of the type of the ear jack may include collecting a noise signal around the electronic device through the main microphone and cancelling the collected noise signal from the second acoustic signal. The cancelling of the collected noise signal may include receiving feedback on a second acoustic signal in which the noise signal is cancelled.

According to various embodiments of the present disclosure, the determining of the type of the ear jack may include comparing the second acoustic signal with the third acoustic signal. The comparing of the second acoustic signal with the third acoustic signal may include collecting a first acoustic signal output from a main speaker of the electronic device through the main microphone and collecting a first acoustic signal output from an ear speaker of the earphone through the ear microphone.

Figure 7A:
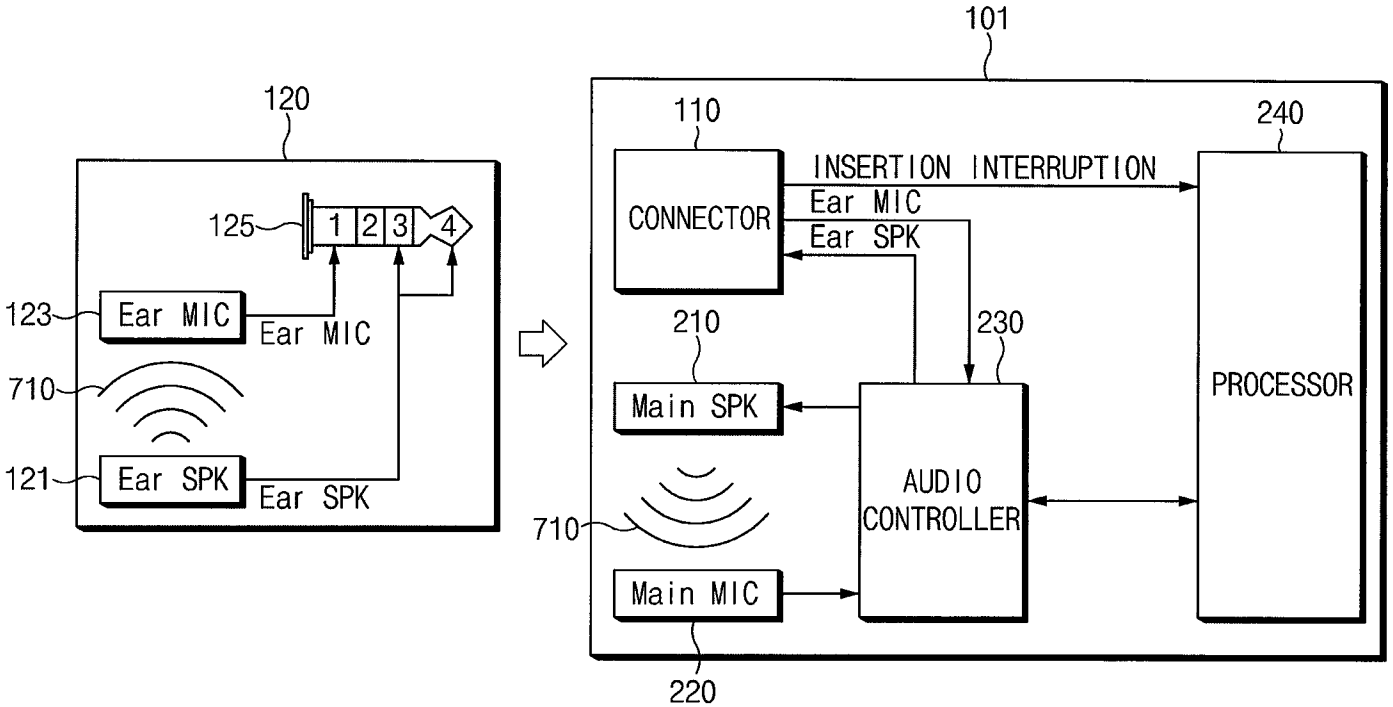
FIGS. 7A and 7B are drawings illustrating a method for recognizing a type of an ear jack using an ear microphone and a main microphone according to various embodiments of the present disclosure.
Figure 7B:
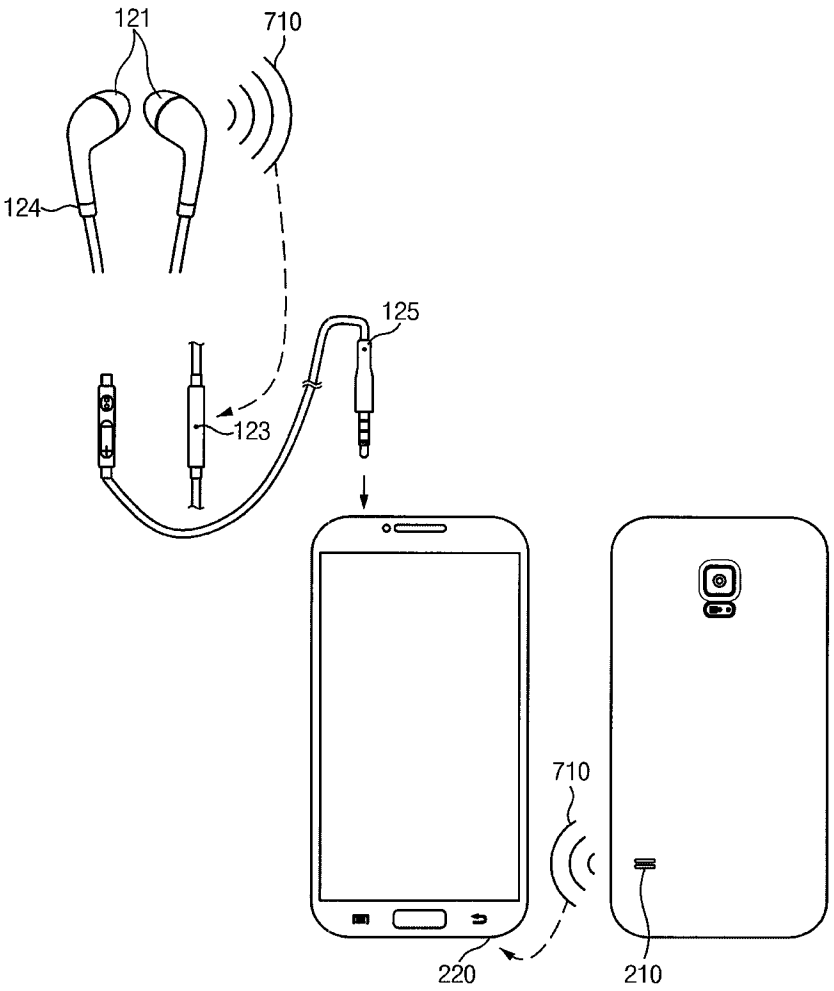

FIGS. 7A and 7B are drawings illustrating a method for recognizing a type of an ear jack using an ear microphone and a main microphone according to various embodiments of the present disclosure.

Referring to FIGS. 7A and 7B, an earphone 120 may include an ear speaker 121, an ear microphone 123, a connection part 124, and an ear jack 125. The ear speaker 121 and the ear microphone 123 may be spaced apart from each other at a predetermined distance (e.g., 15 centimeters to 20 centimeters) and may connect through the connection part 124.

The electronic device 101 may include a connector 110, a main speaker 210, a main microphone 220, an audio controller 230, and a processor 240. In FIG. 7B, an embodiment of the present disclosure is exemplified as the main speaker 210 is disposed in a rear surface of the electronic device 101 and the main microphone 220 is disposed at a lower side of the electronic device 101. However, the scope and spirit of the present disclosure may not be limited thereto.

If receiving an insertion interruption signal from the connector 110, the processor 240 may provide a control signal, for recognizing the ear jack 125, to the audio controller 230. The audio controller 230 may output a first predetermined acoustic signal 710 through each of the ear speaker 121 and the main speaker 210. According to various embodiments of the present disclosure, the signal output through the ear speaker 121 may be introduced into the ear microphone 123, and the signal output through the main speaker 210 may be introduced into the main microphone 220.

The processor 240 may determine whether a second acoustic signal collected through the ear microphone is similar to a third acoustic signal collected through the main microphone 220. If the second acoustic signal and the third acoustic signal are similar to each other, the processor 240 may determine that the ear jack 125 of the four-pole terminal is inserted into the connector 110.

Although not illustrated in FIGS. 7A and 7B, in case of an earphone of a three-pole terminal (e.g., an earphone 120*b* of FIG. 2), the earphone may not collect the output first acoustic signal 710. In this case, a second acoustic signal introduced through a microphone terminal of the connector 110 may be in a state where a constant value is maintained (or a state where there is no collected signal). Therefore, the processor 240 may determine that the second acoustic signal introduced through the microphone terminal of the connector 110 is not similar to the third acoustic signal collected through the main microphone 220. The processor 240 may determine that the ear jack of the three-pole terminal is inserted into the connector 110.

According to various embodiments of the present disclosure, the processor 240 may determine whether a first noise signal collected through the ear microphone 123 is similar to a second noise signal collected through the main microphone 220 and may determine a type of the ear jack 125. If a noise signal around the electronic device 101 has a predetermined value or more, the processor 240 may collect a noise signal through each of the ear microphone 123 and the main microphone 220 and may compare the collected noise signals with each other. If the collected noise signals are similar to each other, the processor 240 may recognize the ear jack 125 as the ear jack of the four-pole terminal. If the collected noise signals are not similar to each other, the processor 240 may recognize the ear jack 125 as the ear jack of the three-pole terminal.

Figure 8A:
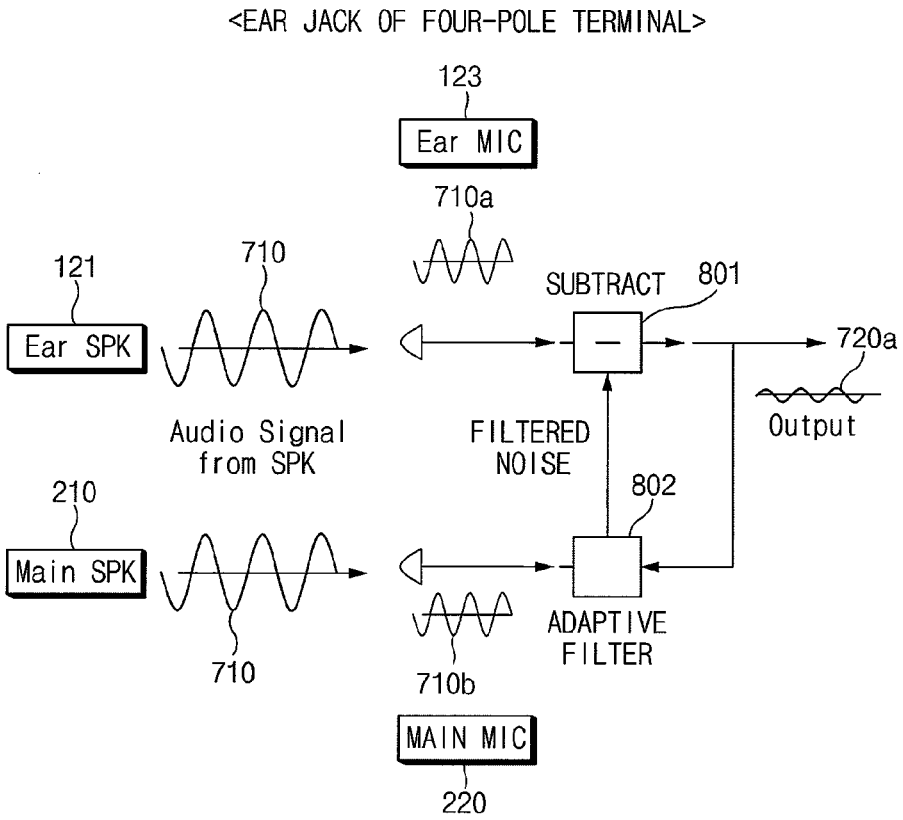
FIGS. 8A and 8B are signal change diagrams illustrating ear jack recognition using an ear microphone and a main microphone according to various embodiments of the present disclosure.
Figure 8B:
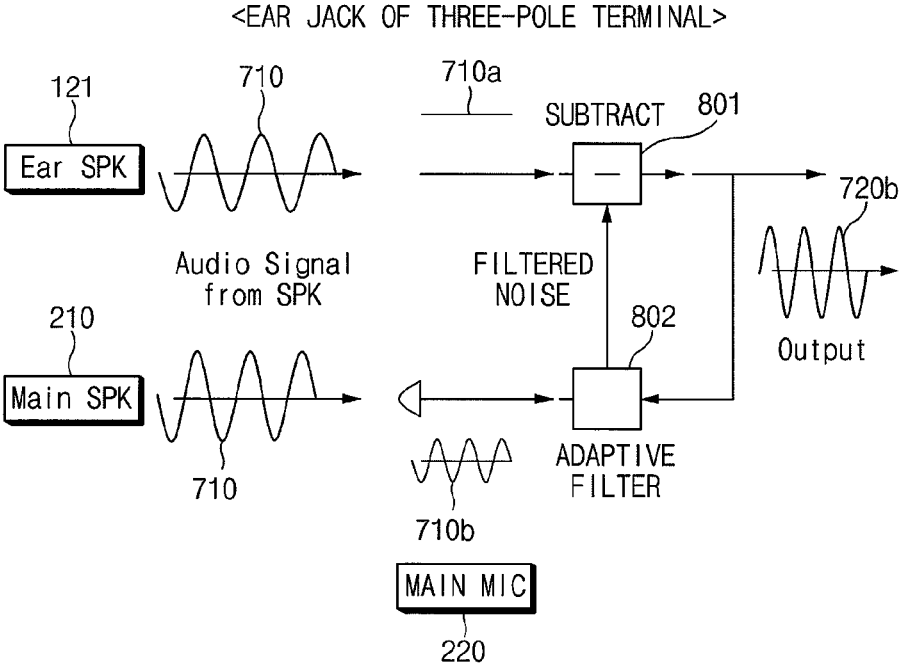

FIGS. 8A and 8B are signal change diagrams illustrating ear jack recognition using an ear microphone and a main microphone according to various embodiments of the present disclosure.

FIG. 8A illustrates a signal change diagram according to insertion of an ear jack of a four-pole terminal.

Referring to FIG. 8A, an audio controller 230 may output a first predetermined acoustic signal through each of an ear speaker 121 and a main speaker 210. According to various embodiments of the present disclosure, the signal output through the ear speaker 121 may be introduced into the ear microphone 123, and the signal output through the main speaker 210 may be introduced into the main microphone 220.

A processor 240 may determine whether a second acoustic signal 710*a* collected through the ear microphone 123 is similar to a third acoustic signal 710*b* collected through the main microphone 220 through a subtractor 801. As shown in FIG. 8A, if the second acoustic signal 710*a* and the third acoustic signal 710*b* are similar to each other, an output signal 720*a* through the subtractor 801 may be attenuated and may have a level of less than a predetermined value. In this case, the processor 240 may determine that an ear jack of a four-pole terminal is inserted into a connector 110 by determining that the second acoustic signal 710*a* and the third acoustic signal 710*b* are similar to each other.

According to various embodiments of the present disclosure, the audio controller 230 may further include an adaptive filter 802. The adaptive filter 802 may improve signal comparison performance by receiving feedback on the output signal 720*a*.

FIG. 8B illustrates a signal change diagram according to insertion of an ear jack of a three-pole terminal.

Referring to FIG. 8B, the audio controller 230 may output a first predetermined acoustic signal through each of the ear speaker 121 and the main speaker 210. Since an earphone having an ear jack of a three-pole terminal may not include a separate ear microphone, a second acoustic signal 710*a* may have a signal of a simple direct current (DC) level.

The processor 240 may determine whether the second acoustic signal 710*a* collected through a microphone terminal of the connector 110 is similar to a third acoustic signal 710*b* collected through the main microphone 220 through a subtractor 801. As shown in FIG. 8B, if the second acoustic signal 710*a* and the third acoustic signal 710*b* are not similar to each other, an output signal 720*b* through the subtractor 801 may not be attenuated and may have a level of a predetermined value or more. In this case, the processor 240 may determine that the ear jack of the three-pole terminal is inserted into the connector 110 by determining that the second acoustic signal 710*a* and the third acoustic signal 710*b* are not similar to each other.

Figure 9:
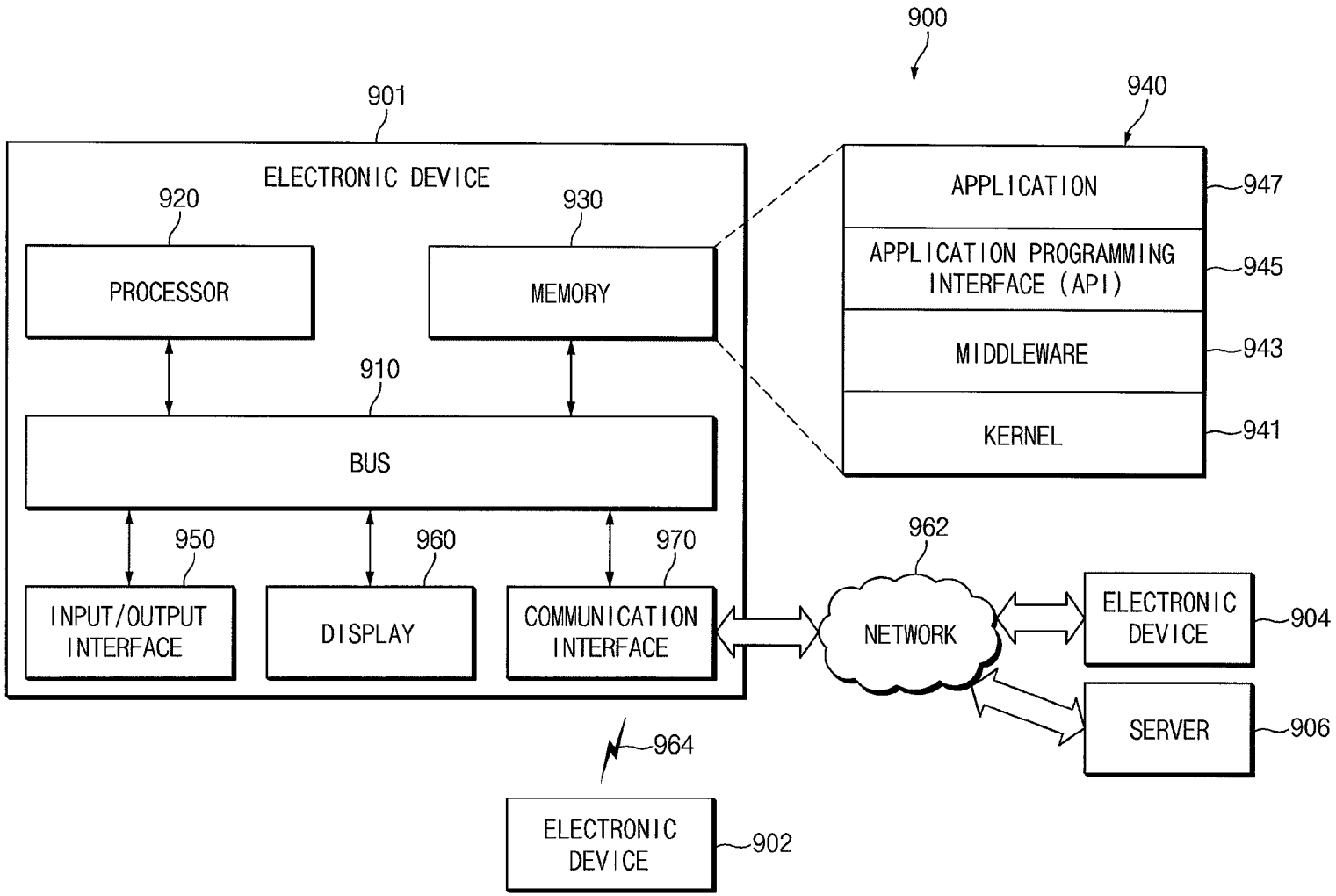
FIG. 9 is a block diagram illustrating a configuration of an electronic device in a network environment according to various embodiments of the present disclosure.

FIG. 9 is a block diagram illustrating a configuration of an electronic device in a network environment according to various embodiments of the present disclosure.

Referring to FIG. 9, an electronic device 901 in a network environment 900 is described according to various embodiments of the present disclosure. The electronic device 901 may include a bus 910, a processor 920, a memory 930, an input and output interface 950, a display 960, and a communication interface 970. In various embodiments of the present disclosure, at least one of the components of the electronic device 901 may be omitted from the electronic device 901 or another component may be additionally included in the electronic device 901.

The bus 910 may be, for example, a circuit which may connect the components 910 to 970 with each other and may transmit communication (e.g., a control message and/or data) between the components.

The processor 920 (e.g., a processor 240 of FIG. 2) may include one or more a central processing unit (CPU), an application processor (AP), and a communication processor (CP). The processor 920 may execute, for example, calculation or data processing about control and/or communication of at least another component of the electronic device 901.

The memory 930 may include a volatile memory and/or a non-volatile memory. For example, the memory 930 may store instructions or data associated with at least another component of the electronic device 901. According to an embodiment of the present disclosure, the memory 930 may store software and/or a program 940. The program 940 may include, for example, a kernel 941, a middleware 943, an application programming interface (API) 945, and/or an application program 947 (or "an application"). At least part of the kernel 941, the middleware 943, or the API 945 may be referred to as an operating system (OS).

The kernel 941 may control or manage, for example, system resources (e.g., the bus 910, the processor 920, or the memory 930, and the like) used to execute an operation or function implemented in the other programs (e.g., the middleware 943, the API 945, or the application program 947). Also, as the middleware 943, the API 945, or the application program 947 accesses a separate component of the electronic device 901, the kernel 941 may provide an interface which may control or manage system resources.

The middleware 943 may play a role as, for example, a go-between such that the API 945 or the application program 947 communicates with the kernel 941 to communicate data with the kernel 941.

Also, the middleware 943 may process one or more work requests received from the application program 947 according to priority. For example, the middleware 943 may provide priority which may use system resources (e.g., the bus 910, the processor 920, or the memory 930, and the like) of the electronic device 901 to at least one of the application program 947. For example, the middleware 943 may perform scheduling or load balancing for the one or more work requests by processing the one or more work requests according to the priority provided to the at least one of the application program 947.

The API 945 may be, for example, an interface in which the application program 947 controls a function provided from the kernel 941 or the middleware 943. For example, the API 945 may include at least one interface or function (e.g., instruction) for file control, window control, image processing, or text control, and the like.

The input and output interface 950 may play a role as, for example, an interface which may transmit instructions or data input from a user or another external device to another component (or other components) of the electronic device 901. Also, input and output interface 970 may output instructions or data received from another component (or other components) of the electronic device 901 to the user or the other external device.

The display 960 may include, for example, a liquid crystal display (LCD), a light emitting diode (LED) display, an organic LED (OLED) display, a microelectromechanical systems (MEMS) display, or an electronic paper display. The display 960 may display, for example, a variety of content (e.g., text, images, videos, icons, or symbols, and the like) to the user. The display 960 may include a touch screen, and may receive, for example, touch, gesture, proximity, or a hovering input using an electronic pen or part of a body of the user.

The communication interface 970 may establish communication between, for example, the electronic device 901 and an external device (e.g., a first external electronic device 902, a second external electronic device 904, or a server 906). For example, the communication interface 970 may connect to a network 962 through wireless communication or wired communication and may communicate with the external device (e.g., the second external electronic device 904 or the server 906).

The wireless communication may use, for example, at least one of long term evolution (LTE), LTE-advanced (LTE-A), code division multiple access (CDMA), wideband CDMA (WCDMA), universal mobile telecommunications system (UMTS), wireless broadband (WiBro), or global system for mobile communications (GSM), and the like as a cellular communication protocol. Also, the wireless communication may include, for example, local-area communication 964. The local-area communication 964 may include, for example, at least one of wireless-fidelity (Wi-Fi) communication, Bluetooth (BT) communication, near field communication (NFC), or global positioning system (GPS) communication, and the like. The wired communication may include at least one of, for example, universal serial bus (USB) communication, high definition multimedia interface (HDMI) communication, recommended standard 232 (RS-232) communication, or plain old telephone service (POTS) communication, and the like. The network 962 may include a telecommunications network, for example, at least one of a computer network (e.g., a local area network (LAN) or a wide area network (WAN)), the Internet, or a telephone network.

Each of the first and second external electronic devices 902 and 904 may be the same as or different device from the electronic device 901. According to an embodiment of the present disclosure, the server 906 may include a group of one or more servers. According to various embodiments of the present disclosure, all or some of operations executed in the electronic device 901 may be executed in another electronic device or a plurality of electronic devices (e.g., the first and second external electronic devices 902 and 904 or the server 906). According to an embodiment of the present disclosure, if performing any function or service automatically or according to a request, the electronic device 901 may request another device (e.g., the first and second external electronic devices 902 and 904 or the server 906) to perform at least a partial function associated with the function or service, rather than executing the function or service for itself or in addition to the function or service. The other electronic device (e.g., the first and second external electronic devices 902 and 904 or the server 906) may execute the requested function or the added function and may transmit the executed result to the electronic device 100. The electronic device 901 may process the received result without change or additionally and may provide the requested function or service. For this purpose, for example, cloud computing technologies, distributed computing technologies, or client-server computing technologies may be used.

Figure 10:
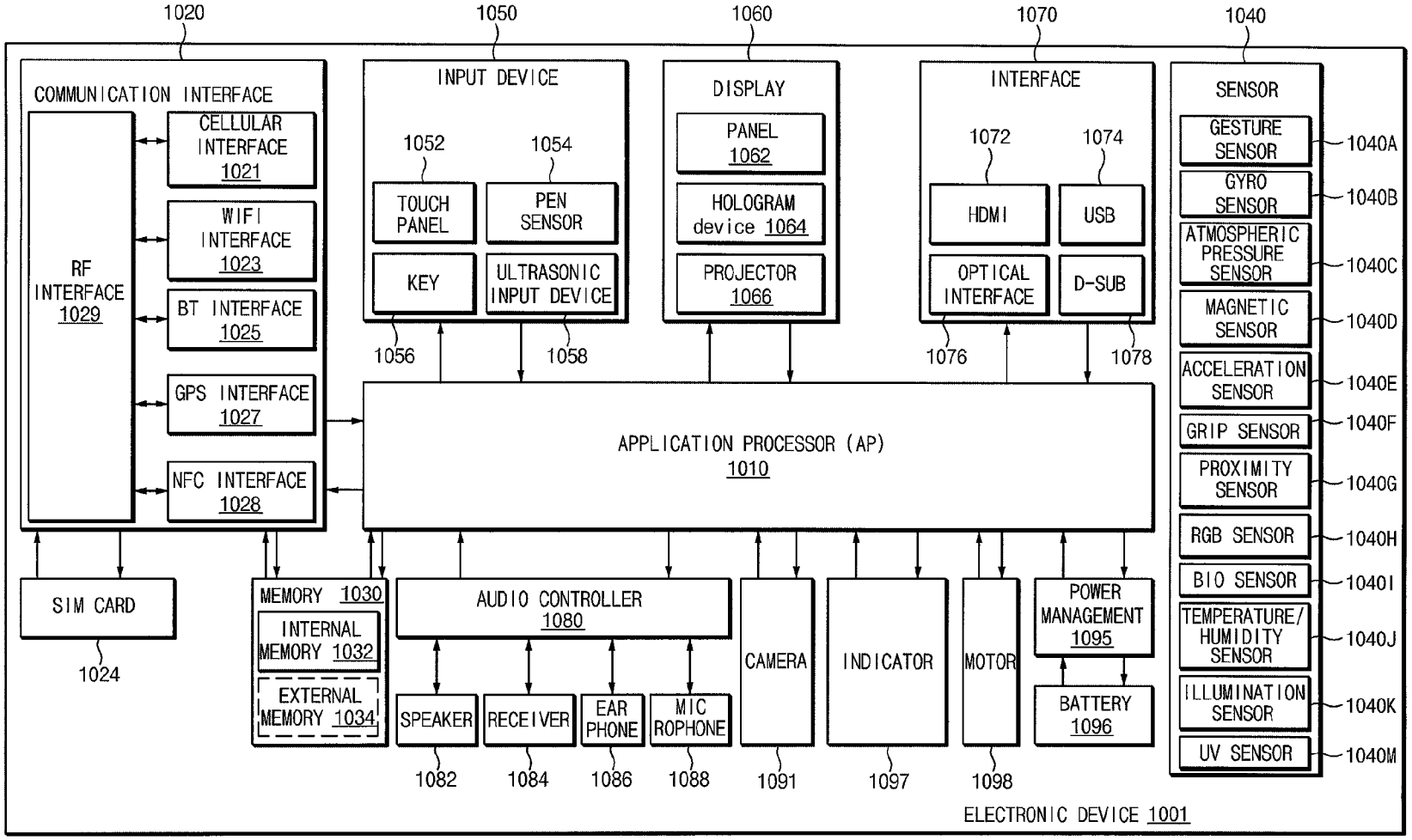
FIG. 10 is a block diagram illustrating a configuration of an electronic device according to various embodiments of the present disclosure.

FIG. 10 is a block diagram 1000 illustrating a configuration of an electronic device 1001 according to various embodiments of the present disclosure.

Referring to FIG. 10, the electronic device 1001 may include, for example, all or part of an electronic device 901 shown in FIG. 9. The electronic device 1001 may include one or more application processors (APs) 1010, a communication interface 1020, a subscriber identification module (SIM) card 1024, a memory 1030, a sensor 1040, an input device 1050, a display 1060, an interface 1070, an audio controller 1080, a camera 1091, a power management 1095, a battery 1096, an indicator 1097, and a motor 1098.

The AP 1010 may drive, for example, an operating system (OS) or an application program to control a plurality of hardware or software components connected thereto and may process and compute a variety of data. The AP 1010 may be implemented with, for example, a system on chip (SoC). According to an embodiment of the present disclosure, the AP 1010 may further include a graphic processing unit (GPU) (not shown) and/or an image signal processor (not shown). The AP 1010 may include at least some (e.g., a cellular interface 1021) of the components shown in FIG. 10. The AP 1010 may load instructions or data received from at least one of other components (e.g., a non-volatile memory) to a volatile memory to process the data and may store various data in a non-volatile memory.

The communication interface 1020 may have the same or similar configuration as or to that of a communication interface 970 of FIG. 9. The communication interface 1020 may include, for example, the cellular interface 1021, a wireless-fidelity (Wi-Fi) interface 1023, a Bluetooth (BT) interface 1025, a global positioning system (GPS) interface 1027, a near field communication (NFC) interface 1028, and a radio frequency (RF) interface 1029.

The cellular interface 1021 may provide, for example, a voice call service, a video call service, a text message service, or an Internet service, and the like through a communication network. According to an embodiment of the present disclosure, the cellular interface 1021 may identify and authenticate the electronic device 1001 in a communication network using a SIM (e.g., the SIM card 1024). According to an embodiment of the present disclosure, the cellular interface 1021 may perform at least some of functions which may be provided by the AP 1010. According to an embodiment of the present disclosure, the cellular interface 1021 may include a communication processor (CP).

The Wi-Fi interface 1023, the BT interface 1025, the GPS interface 1027, or the NFC interface 1028 may include, for example, a processor for processing data transmitted and received through the corresponding interface. According to various embodiments of the present disclosure, at least some (e.g., two or more) of the cellular interface 1021, the Wi-Fi interface 1023, the BT interface 1025, the GPS interface 1027, or the NFC interface 1028 may be included in one integrated chip (IC) or one IC package.

The RF interface 1029 may transmit and receive, for example, a communication signal (e.g., an RF signal). Though not shown, the RF interface 1029 may include, for example, a transceiver, a power amplifier module (PAM), a frequency filter, or a low noise amplifier (LNA), or an antenna, and the like. According to another embodiment of the present disclosure, at least one of the cellular interface 1021, the Wi-Fi interface 1023, the BT interface 1025, the GPS interface 1027, or the NFC interface 1028 may transmit and receive an RF signal through a separate RF module.

The SIM card 1024 may include, for example, a card which includes a SIM and/or an embedded SIM. The SIM card 1024 may include unique identification information (e.g., an integrated circuit card identifier (ICCID)) or subscriber information (e.g., an international mobile subscriber identity (IMSI)).

The memory 1030 (e.g., a memory 930 of FIG. 9) may include, for example, an embedded memory 1032 or an external memory 1034. The embedded memory 1032 may include at least one of, for example, a volatile memory (e.g., a dynamic random access memory (DRAM), a static RAM (SRAM), a synchronous dynamic RAM (SDRAM), and the like), or a non-volatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory, and the like), a hard drive, or a solid state drive (SSD)).

The external memory 1034 may further include a flash drive, for example, a compact flash (CF), a secure digital (SD), a micro-SD, a mini-SD, an extreme digital (xD), or a memory stick, and the like. The external memory 1034 may functionally and/or physically connect with the electronic device 1001 through various interfaces.

The sensor 1040 may measure, for example, a physical quantity or may detect an operation state of the electronic device 1001, and may convert the measured or detected information to an electric signal. The sensor 1040 may include at least one of, for example, a gesture sensor 1040A, a gyro sensor 1040B, a barometric pressure sensor 1040C, a magnetic sensor 1040D, an acceleration sensor 1040E, a grip sensor 1040F, a proximity sensor 1040G, a color sensor 1040H (e.g., red, green, blue (RGB) sensor), a biometric sensor 1040I, a temperature/humidity sensor 1040J, an illumination sensor 1040K, or an ultraviolet (UV) sensor 1040M. Additionally or alternatively, the sensor 1040 may further include, for example, an e-nose sensor (not shown), an electromyography (EMG) sensor (not shown), an electroencephalogram (EEG) sensor (not shown), an electrocardiogram (ECG) sensor (not shown), an infrared (IR) sensor (not shown), an iris sensor (not shown), and/or a fingerprint sensor (not shown), and the like. The sensor 1040 may further include a control circuit for controlling at least one or more sensors included therein. According to various embodiments of the present disclosure, the electronic device 1001 may further include a processor configured to control the sensor 1040, as part of the AP 1010 or to be independent of the AP 1010. While the AP 1010 is in a sleep state, the electronic device 1001 may control the sensor 1040.

The input device 1050 may include, for example, a touch panel 1052, a (digital) pen sensor 1054, a key 1056, or an ultrasonic input unit 1058. The touch panel 1052 may recognize a touch input using at least one of, for example, a capacitive detecting method, a resistive detecting method, an infrared detecting method, or an ultrasonic detecting method. Also, the touch panel 1052 may further include a control circuit. The touch panel 1052 may further include a tactile layer and may provide a tactile reaction to a user.

The (digital) pen sensor 1054 may be, for example, part of a touch panel or may include a separate sheet for recognition. The key 1056 may include, for example, a physical button, an optical key, or a keypad. The ultrasonic input unit 1058 may allow the electronic device 1001 to detect a sound wave using a microphone (e.g., a microphone 1088) and to verify data through an input tool generating an ultrasonic signal.

The display 1060 (e.g., a display 960 of FIG. 9) may include a panel 1062, a hologram device 1064, or a projector 1066. The panel 1062 may include the same or similar configuration as or to that of the display 960. The panel 1062 may be implemented to be, for example, flexible, transparent, or wearable. The panel 1062 and the touch panel 1052 may be integrated into one panel. The hologram device 1064 may show a stereoscopic image in a space using interference of light. The projector 1066 may project light onto a screen to display an image. The screen may be positioned, for example, inside or outside the electronic device 1001. According to an embodiment of the present disclosure, the display 1060 may further include a control circuit for controlling the panel 1062, the hologram device 1064, or the projector 1066.

The interface 1070 may include, for example, a high-definition multimedia interface (HDMI) 1072, a universal serial bus (USB) 1074, an optical interface 1076, or a D-subminiature 1078. The interface 1070 may be included in, for example, a communication interface 970 shown in FIG. 9. Additionally or alternatively, the interface 1070 may include, for example, a mobile high definition link (MHL) interface, an SD card/multimedia card (MMC) interface, or an infrared data association (IrDA) standard interface.

The audio controller 1080 (e.g., an audio controller 230 of FIG. 2) may convert a sound and an electric signal in dual directions. At least some of components of the audio controller 1080 may be included in, for example, an input and output interface 950 shown in FIG. 9. The audio controller 1080 may process sound information input or output through, for example, a speaker 1082, a receiver 1084, an earphone 1086, or the microphone 1088, and the like. The microphone 1088 included in the audio controller 1080 may collect audio data which may be used as input information and remote authentication information or local authentication information.

The camera 1091 may be a device which captures a still image and a moving image. According to an embodiment of the present disclosure, the camera 1091 may include one or more image sensors (not shown) (e.g., a front sensor or a rear sensor), a lens (not shown), an image signal processor (ISP) (not shown), or a flash (not shown) (e.g., an LED or a xenon lamp).

The power management 1095 may manage, for example, power of the electronic device 1001. According to an embodiment of the present disclosure, though not shown, the power management 1095 may include a power management integrated circuit (PMIC), a charger IC or a battery or fuel gauge. The PMIC may have a wired charging method and/or a wireless charging method. The wireless charging method may include, for example, a magnetic resonance method, a magnetic induction method, or an electromagnetic method, and the like. An additional circuit for wireless charging, for example, a coil loop, a resonance circuit, or a rectifier, and the like may be further provided. The battery gauge may measure, for example, the remaining capacity of the battery 1096 and voltage, current, or temperature thereof while the battery 1096 is charged. The battery 1096 may include, for example, a rechargeable battery or a solar battery.

The indicator 1097 may display a specific state of the electronic device 1001 or part (e.g., the AP 1010) thereof, for example, a booting state, a message state, or a charging state, and the like. The motor 1098 may convert an electric signal into mechanical vibration and may generate vibration or a haptic effect, and the like. Though not shown, the electronic device 1001 may include a processing unit (e.g., a GPU) for supporting a mobile TV. The processing unit for supporting the mobile TV may process media data according to standards, for example, a digital multimedia broadcasting (DMB) standard, a digital video broadcasting (DVB) standard, or a MediaFlo™ standard, and the like.

Each of the above-mentioned elements of the electronic device according to various embodiments of the present disclosure may be configured with one or more components, and names of the corresponding elements may be changed according to the type of the electronic device. The electronic device according to various embodiments of the present disclosure may include at least one of the above-mentioned elements, some elements may be omitted from the electronic device, or other additional elements may be further included in the electronic device. Also, some of the elements of the electronic device according to various embodiments of the present disclosure may be combined with each other to form one entity, thereby making the electronic device possible to perform the functions of the corresponding elements in the same manner as before the combination.

Figure 11:
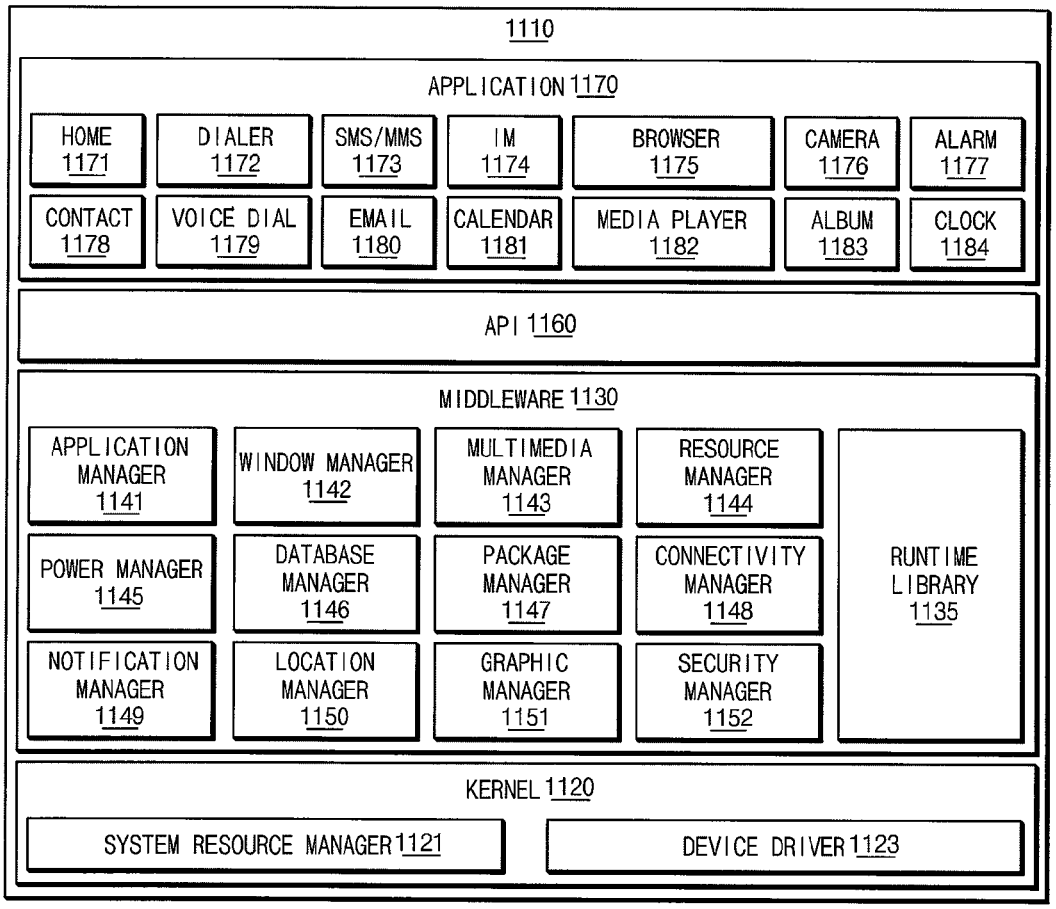
FIG. 11 is a block diagram illustrating a configuration of a program module according to various embodiments of the present disclosure.

FIG. 11 is a block diagram illustrating a configuration of a program module 1110 according to various embodiments of the present disclosure.

Referring to FIG. 11, according to an embodiment of the present disclosure, the program module 1110 (e.g., a program 940 of FIG. 9) may include an operating system (OS) for controlling resources associated with an electronic device (e.g., an electronic device 901 of FIG. 9) and/or various applications (e.g., an application 947 of FIG. 9) which are executed on the OS. The OS may be, for example, Android, iOS, Windows, Symbian, Tizen, or Bada, and the like.

The program module 1110 may include a kernel 1120, a middleware 1130, an application programming interface (API) 1160, and/or an application 1170. At least part of the program module 1110 may be preloaded on the electronic device, or may be downloaded from an external electronic device (e.g., first and second external electronic devices 902 and 904 or a server 906 of FIG. 9).

The kernel 1120 (e.g., a kernel 941 of FIG. 9) may include, for example, a system resource manager 1121 and/or a device driver 1123. The system resource manager 1121 may control, assign, or collect, and the like system resources. According to an embodiment of the present disclosure, the system resource manager 1121 may include a process management unit, a memory management unit, or a file system management unit, and the like. The device driver 1123 may include, for example, a display driver, a camera driver, a Bluetooth (BT) driver, a shared memory driver, a universal serial bus (USB) driver, a keypad driver, a wireless-fidelity (Wi-Fi) driver, an audio driver, or an inter-process communication (IPC) driver.

The middleware 1130 (e.g., a middleware 943 of FIG. 9) may provide, for example, functions the application 1170 needs in common, and may provide various functions to the application 1170 through the API 1160 such that the application 1170 efficiently uses limited system resources in the electronic device. According to an embodiment of the present disclosure, the middleware 1130 (e.g., the middleware 943) may include at least one of a runtime library 1135, an application manager 1141, a window manager 1142, a multimedia manager 1143, a resource manager 1144, a power manager 1145, a database manager 1146, a package manager 1147, a connectivity manager 1148, a notification manager 1149, a location manager 1150, a graphic manager 1151, or a security manager 1152.

The runtime library 1135 may include, for example, a library module used by a compiler to add a new function through a programming language while the application 1170 is executed. The runtime library 1135 may perform a function about input and output management, memory management, or an arithmetic function.

The application manager 1141 may manage, for example, a life cycle of at least one of the application 1170. The window manager 1142 may manage graphic user interface (GUI) resources used on a screen of the electronic device. The multimedia manager 1143 may ascertain a format necessary for reproducing various media files and may encode or decode a media file using a codec corresponding to the corresponding format. The resource manager 1144 may manage source codes of at least one of the application 1170, and may manage resources of a memory or a storage space, and the like.

The power manager 1145 may act together with, for example, a basic input/output system (BIOS) and the like, may manage a battery or a power source, and may provide power information necessary for an operation of the electronic device. The database manager 1146 may generate, search, or change a database to be used in at least one of the application 1170. The package manager 1147 may manage installation or update of an application distributed by a type of a package file.

The connectivity manager 1148 may manage, for example, wireless connection such as Wi-Fi connection or BT connection, and the like. The notification manager 1149 may display or notify events, such as an arrival message, an appointment, and proximity notification, by a method which is not disturbed to the user. The location manager 1150 may manage location information of the electronic device. The graphic manager 1151 may manage a graphic effect to be provided to the user or a user interface (UI) related to the graphic effect. The security manager 1152 may provide all security functions necessary for system security or user authentication, and the like. According to an embodiment of the present disclosure, when the electronic device (e.g., the electronic device 901) has a phone function, the middleware 1130 may further include a telephony manager (not shown) for managing a voice or video communication function of the electronic device.

The middleware 1130 may include a middleware module which configures combinations of various functions of the above-described components. The middleware 1130 may provide a module which specializes according to kinds of OSs to provide a differentiated function. Also, the middleware 1130 may dynamically delete some of old components or may add new components.

The API 1160 (e.g., an API 945 of FIG. 9) may be, for example, a set of API programming functions, and may be provided with different components according to OSs. For example, in case of Android or iOS, one API set may be provided according to platforms. In case of Tizen, two or more API sets may be provided according to platforms.

The application 1170 (e.g., an application program 947 of FIG. 9) may include one or more of, for example, a home application 1171, a dialer application 1172, a short message service/multimedia message service (SMS/MMS) application 1173, an instant message (IM) application 1174, a browser application 1175, a camera application 1176, an alarm application 1177, a contact application 1178, a voice dial application 1179, an e-mail application 1180, a calendar application 1181, a media player application 1182, an album application 1183, a clock application 1184, a health care application (e.g., an application for measuring quantity of exercise or blood sugar, and the like), or an environment information application (e.g., an application for providing atmospheric pressure information, humidity information, or temperature information, and the like), and the like.

According to an embodiment of the present disclosure, the application 1070 may include an application (hereinafter, for better understanding and ease of description, referred to as "information exchange application") for exchanging information between the electronic device (e.g., the electronic device 100) and an external electronic device (e.g., first and second external electronic devices 902 and 904 of FIG. 9). The information exchange application may include, for example, a notification relay application for transmitting specific information to the external electronic device or a device management application for managing the external electronic device.

For example, the notification relay application may include a function of transmitting notification information, which is generated by other applications (e.g., the SMS/MMS application, the e-mail application, the health care application, or the environment information application, and the like) of the electronic device, to the external electronic device (e.g., the first and second external electronic devices 902 and 904). Also, the notification relay application may receive, for example, notification information from the external electronic device, and may provide the received notification information to the user of the electronic device.

The device management application may manage (e.g., install, delete, or update), for example, at least one (e.g., a function of turning on/off the external electronic device itself (or partial components) or a function of adjusting brightness (or resolution) of a display) of functions of the external electronic device (e.g., the first and second external electronic devices 902 and 904) which communicates with the electronic device, an application which operates in the external electronic device, or a service (e.g., a call service or a message service) provided from the external electronic device.

According to an embodiment of the present disclosure, the application 1170 may include an application (e.g., the health card application of a mobile medical device) which is preset according to attributes of the external electronic device (e.g., the first and second external electronic devices 902 and 904). According to an embodiment of the present disclosure, the application 1170 may include an application received from the external electronic device (e.g., the server 906 or the first and second external electronic devices 902 and 904). According to an embodiment of the present disclosure, the application 1170 may include a preloaded application or a third party application which may be downloaded from a server. Names of the components of the program module 1110 according to various embodiments of the present disclosure may differ according to kinds of OSs.

According to various embodiments of the present disclosure, at least part of the program module 1110 may be implemented with software, firmware, hardware, or at least two or more combinations thereof. At least part of the program module 1110 may be implemented (e.g., executed) by, for example, a processor (e.g., a processor 1010 of FIG. 10). At least part of the program module 1010 may include, for example, a module, a program, a routine, sets of instructions, or a process, and the like for performing one or more functions.

Each of the above-mentioned elements of the electronic device according to various embodiments of the present disclosure may be configured with one or more components, and names of the corresponding elements may be changed according to the type of the electronic device. The electronic device according to various embodiments of the present disclosure may include at least one of the above-mentioned elements, some elements may be omitted from the electronic device, or other additional elements may be further included in the electronic device. Also, some of the elements of the electronic device according to various embodiments of the present disclosure may be combined with each other to form one entity, thereby making the electronic device possible to perform the functions of the corresponding elements in the same manner as before the combination.

The terminology "module" used herein may mean, for example, a unit including one of hardware, software, and firmware or two or more combinations thereof. The terminology "module" may be interchangeably used with, for example, terminologies "unit", "logic", "logical block", "component", or "circuit", and the like. The "module" may be a minimum unit of an integrated component or a part thereof. The "module" may be a minimum unit performing one or more functions or a part thereof. The "module" may be mechanically or electronically implemented. For example, the "module" may include at least one of an application-specific integrated circuit (ASIC) chip, field-programmable gate arrays (FPGAs), or a programmable-logic device, which is well known or will be developed in the future, for performing certain operations.

According to various embodiments of the present disclosure, at least part of the electronic device (e.g., modules or the functions) or the method (e.g., operations) may be implemented with, for example, instructions stored in a computer-readable storage media which has a program module. When the instructions are executed by a processor (e.g., a processor 920 of FIG. 9), one or more processors may perform functions corresponding to the instructions. The computer-readable storage media may be, for example, a memory 930 of FIG. 9.

The computer-readable storage media may include a hard disc, a floppy disk, magnetic media (e.g., a magnetic tape), optical media (e.g., a compact disc read only memory (CD-ROM) and a digital versatile disc (DVD)), magneto-optical media (e.g., a floptical disk), a hardware device (e.g., a ROM, a random access memory (RAM), or a flash memory, and the like), and the like. Also, the program instructions may include not only mechanical codes compiled by a compiler but also high-level language codes which may be executed by a computer using an interpreter and the like. The above-mentioned hardware device may be configured to operate as one or more software modules to perform operations according to various embodiments of the present disclosure, and vice versa.

Modules or program modules according to various embodiments of the present disclosure may include at least one or more of the above-mentioned components, some of the above-mentioned components may be omitted, or other additional components may be further included. Operations executed by modules, program modules, or other elements according to various embodiments of the present disclosure may be executed by a successive method, a parallel method, a repeated method, or a heuristic method. Also, some operations may be executed in a different order or may be omitted, and other operations may be added.

According to various embodiments of the present disclosure, the electronic device may recognize a type of an ear jack using an original function of a microphone without adding a circuit.

According to various embodiments of the present disclosure, the electronic device may recognize a type of an ear jack using a noise cancellation function in a situation where a noise occurs around the electronic device.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device connected to an earphone, comprising:

a connector into which an ear jack of the earphone is inserted;

an audio controller configured to process an acoustic signal;

a processor configured to control the audio controller; and a memory configured to functionally connect with the processor, wherein the audio controller outputs a first acoustic signal through an ear speaker of the earphone, if an insertion interruption occurs according to insertion of the ear jack, and wherein the processor determines a type of the ear jack according to a second acoustic signal collected through an ear microphone included in the earphone.

2. The electronic device of claim 1, wherein the processor compares the first acoustic signal previously stored in the memory with the second acoustic signal and determines the type of the ear jack according to the compared result.

3. The electronic device of claim 1, further comprising:

a main speaker, wherein the audio controller outputs the first acoustic signal through at least one of the ear speaker or the main speaker.

4. The electronic device of claim 1, further comprising:

a main microphone, wherein the processor determines the type of the ear jack according to at least one of the second acoustic signal collected through the ear microphone or a third acoustic signal collected through the main microphone.

5. The electronic device of claim 4, wherein the main microphone collects a noise signal around the electronic device, wherein the audio controller cancels the collected noise signal from the second acoustic signal.

6. The electronic device of claim 5, wherein the audio controller receives a feedback on the second acoustic signal in which the noise signal is canceled.

7. The electronic device of claim 4, wherein the processor compares the second acoustic signal with the third acoustic signal and determines the type of the ear jack according to the compared result.

8. The electronic device of claim 4, wherein the main microphone collects the first acoustic signal output from the main speaker, and wherein the ear microphone collects the first acoustic signal output from the ear speaker.

9. The electronic device of claim 1, wherein the first acoustic signal is an inaudible signal or an audible signal of a predetermined frequency or less.

10. The electronic device of claim 1, wherein the ear jack has one of a form of a three-pole terminal including a ground terminal, a right output terminal, and a left output terminal and a form of a four-pole terminal including a microphone terminal, a ground terminal, a right speaker terminal, and a left speaker terminal.

11. The electronic device of claim 1, wherein the first acoustic signal is repeatedly output at time intervals.

12. A method of operating an ear jack recognition in an electronic device, the method comprising:

outputting a first acoustic signal, if an insertion interruption of an ear jack connected to an earphone occurs; and determining a type of the ear jack according to a second acoustic signal collected through an ear microphone of the earphone in response to the first acoustic signal.

13. The method of claim 12, wherein the determining of the type of the ear jack comprises:

comparing the first acoustic signal previously stored in a memory with the second acoustic signal; and determining the type of the ear jack according to the compared result.

14. The method of claim 12, wherein the outputting of the first acoustic signal comprises:

outputting the first acoustic signal through at least one of an ear speaker of the earphone or a main speaker of the electronic device.

15. The method of claim 12, wherein the determining of the type of the ear jack comprises:

collecting the second acoustic signal through the ear microphone;

collecting a third acoustic signal through a main microphone of the electronic device; and determining the type of the ear jack according to at least one of the second acoustic signal or the third acoustic signal.

16. The method of claim 15, wherein the determining of the type of the ear jack comprises:

collecting a noise signal around the electronic device through the main microphone; and canceling the collected noise signal from the second acoustic signal.

17. The method of claim 16, wherein the canceling of the collected noise signal comprises:

receiving a feedback on the second acoustic signal, in which the noise signal is canceled, through an adaptive filter.

18. The method of claim 15, wherein the determining of the type of the ear jack comprises:

comparing the second acoustic signal with the third acoustic signal.

19. The method of claim 18, wherein the comparing of the second acoustic signal with the third acoustic signal comprises:

collecting the first acoustic signal output from a main speaker of the electronic device through the main microphone; and collecting the first acoustic signal output from an ear speaker of the earphone through the ear microphone.

20. The method of claim 12, wherein the first acoustic signal is an inaudible signal or an audible signal of a predetermined frequency or less.

* * * * *